United States Patent [19]

Yoneda et al.

[11] 4,149,613

[45] Apr. 17, 1979

[54] ELEVATOR CONTROL SYSTEM

[75] Inventors: Kenji Yoneda; Masao Nakazato; Takeo Yuminaka, all of Katsuta, Japan

[73] Assignee: Hitachi, Ltd., Japan

[21] Appl. No.: 737,170

[22] Filed: Nov. 1, 1976

[30] Foreign Application Priority Data

| | | | |
|---|---|---|---|
| Nov. 4, 1975 | [JP] | Japan | 50/131471 |
| Feb. 4, 1976 | [JP] | Japan | 51/10366 |
| Feb. 6, 1976 | [JP] | Japan | 51/11401 |

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,739,880 | 6/1973 | Robaszkiewicz | 187/29 |
| 3,851,733 | 12/1974 | Sackin et al. | 187/29 |
| 3,851,734 | 12/1974 | Sackin | 187/29 |
| 4,046,228 | 9/1977 | Powell | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

An elevator control system for controlling a plurality of elevator cars servicing a plurality of floors of a building by allotting a hall call originated from one of the floors to a suitable one of the elevator cars so that the hall call can be serviced by the selected elevator car. In the elevator control system, a scan signal generator is provided to generate a scan signal which is used to sequentially scan the floors in successive scan slots for detecting hall calls and elevator car service positions and converting the detected information into pulse signals. The elevator control system comprises counters for counting up the service loads of the individual elevator cars in the successive scan slots after the detection of the elevator car service positions, so that, when a hall call is detected in one of the scan slots, an elevator car providing a minimum service load at the specific scan slot can be selected, and the detected hall call can be allotted to the selected elevator car. The elevator control system of such construction may be divided into a plurality of blocks classified by their control functions. These blocks are electrically isolated from one another by isolating means which permits transmission of signals among them. In a modification, the scan signal generator may be provided in each of the blocks.

23 Claims, 22 Drawing Figures

| FLOOR No. | SF SLOT No. | UP HALL CALL | CAR No. 1 | CAR No. 2 | | CAR No. 7 | CAR No. 8 | DOWN HALL CALL | SF SLOT No. |
|---|---|---|---|---|---|---|---|---|---|
| 7F | | | | | | | | | 27 |
| 6F | 10 | | | | | STOP | | | 26 |
| 5F | 9 | △5U | | | | | | | 25 |
| 4F | 8 | | | ○(2)4C | | | | | 24 |
| 3F | 7 | △3U | | | | | | | 23 |
| 2F | 6 | | | ⇧ | | | | | 22 |
| | 5 | | | RUN | | | | | 21 |
| 1F | 4 | | STOP | | | | MGOFF | ▽ID | 20 |
| BF | 3 | | | | | | | | |

ELEVATOR CONTROL SYSTEM

This invention relates to the art of control of elevator cars, and more particular to an improved elevator control system suitable for allotting control of a hall call originated from one of a plurality of floors of a building to a suitable one of the elevator cars.

Various elevator control systems of high allotting control efficiency have been proposed heretofore, in which a hall call originated from one of a plurality of floors of a building is allotted to a suitable one of a plurality of elevator cars taking into account the factors including the elevator car position and traffic demand, so as to organically correlate the running conditions of the elevator cars to provide improved elevator service. The proposed elevator control systems include control units consisting of, for example, analog circuits or digital circuits.

However, the prior art elevator control systems of high allotting control efficiency have generally had the following defects:

(1) Extremely complex control circuits are generally required, and an excessively large number of connecting conductors must be provided to interconnect these control circuits, resulting in excessively high costs.

(2) The defect pointed out in (1) becomes more marked with the increase in the number of floors or the number of elevator cars to such an extent that it is almost impossible to apply such a control system with a high allotting control efficiency to a multistory building.

(3) The design of the elevator control system must be altered depending on the number of floors of a building and the number of elevator cars installed in the building. Thus, difficulty is encountered in the standardization of the design of the elevator control system.

(4) Therefore, the prior art elevator control system of high allotting control efficiency thus developed can only find a limited range of practical applications by being limited by the number of floors, the number of elevator cars, estimated costs, etc.

(5) The prior art elevator control system of complex structure is difficult to satisfactorily maintain and inspect, and it is also necessary to prepare many spare parts to deal with trouble or failure.

An elevator control system has recently been proposed, in which a scan signal generator is provided for detecting hall calls by scanning with the scan signal, and an electronic computer is used as means for allotting these hall calls to suitable ones of a plurality of elevator cars servicing a plurality of floors of a building. Such an elevator control system is disclosed in U.S. Pat. No. 3,804,209 and U.S. Pat. No. 3,854,554. The scan signal is a binary-coded signal adapted for identification of each individual floor of the building, and such scan signal is used to detect hall calls in a time division fashion. Various information inputs including the position of each individual elevator car, the running direction of each individual elevator car and the traffic demand are applied to the electronic computer which processes these information inputs according to a predetermined program so as to detect for each of the elevator cars the number of floors which cannot be serviced although they have originated the hall calls. The data signal representing the unserviced floors thus detected for the individual elevator cars is applied to an inhibit signal generator so that the data signal can be synchronized with the hall call signals detected as a result of scanning with the scan signal. The scan signal is also applied to the inhibit signal generator, in which the unserviced floor data is converted into a signal synchronous with the scan signal to appear as an inhibit signal output. A drive control unit is provided for each individual elevator car, and the inhibit signal output of the inhibit signal generator and the hall call signals detected as the result of scanning with the scan signal are applied thereto. Among the hall call signal inputs applied to the drive control unit, those hall calls which are not inhibited by the inhibit signal are selected to be serviced by the elevator car.

This inhibit signal does not appear from the inhibit signal generator in the event of faulty operation of the electronic computer used as the hall call allotting control means. In such a case, the elevator cars are instructed to service the successive hall calls originated from the floors. That is, the allotting control is automatically changed over to the usual manner of elevator control in which the hall call allotting control is not carried out.

The proposed elevator control system is effective in eliminating most of the prior art defects pointed out hereinbefore. However, this proposed control system has still been quite expensive for the following reasons:

(1) The electronic computer is expensive, and the exclusive use of the computer for the sole purpose of hall call allotting control is wasteful.

(2) The control system is complex in structure and expensive since the control section comprising the electronic computer and that operating in response to the application of the scan signal are not arranged for synchronous operation. For instance, the hall call signals detected as the result of scanning with the scan signal are not synchronous with the data output of the computer representing the unserviced floors computed by the computer. Therefore, the data output of computer representing the unserviced floors is applied to the inhibit signal generator in the proposed system so that it can be converted into the signal synchronous with the scan signal. This signal conversion requires means for continuously storing the data computed by the computer. In addition to the above disadvantage, various undesirable situations tend to appear due to the lack of synchronous operation of the entire elevator control system.

It is therefore a first object of the present invention to provide an improved elevator control system of the kind above described which is quite simple in construction and inexpensive, which can be easily adapted for the allotting control without regard to the number of elevator cars and the number of service floors of a building, and which can thus be easily standardized in design.

A second object of the present invention is to provide an improved elevator control system of the kind above described which is highly reliable and reduces the possibility of shutdown due to abnormal operation or the like.

It is a first important feature of the elevator control system according to the present invention that a scan signal generator is provided for generating a scan signal for scanning sequentially the entire service floor range of a building in one direction and then the other in successive scan slots to detect and convert hall calls and elevator car service positions into corresponding pulse signals, and when a hall call converted into a pulse signal by the scan signal is detected, this hall call is allotted to one of a plurality of elevator cars selected on the basis of the information including at least the elevator car service position converted into the pulse signal before the scanning of the hall call in the associated scan slot, so that all of the control operations including detection of a hall call, detection of the elevator car service positions, selection of an elevator car suitable for servicing the hall call, and allotment of the hall call to the selected elevator car can be carried out in synchronous relation with the scan signal.

A second important feature of the present invention resides in the fact that all of the means controlled by the scan signal are divided into a plurality of blocks classified by their control functions, these blocks being electrically isolated from one another by means which permits the transmission of various signals among them, and the scan signal generator is provided in each of these blocks.

Other objects and features of the present invention will become apparent from the following detailed description of preferred embodiments thereof taken in conjunction with the accompanying drawing, in which:

FIGS. 2 to 12 show the practical form and operation of the individual blocks in the block diagram shown in FIG. 1, wherein:

FIG. 2 is a circuit diagram of a control pulse generator and a scan signal generator;

FIG. 4 is a block diagram showing schematically the structure of a hall call allotting control unit;

FIG. 5 is a circuit diagram of a service load computing unit shown in FIG. 4;

FIG. 6 is a circuit diagram of an elevator car selecting unit shown in FIG. 4;

FIG. 7 is a diagram illustrating the service state of a plurality of elevator cars, by way of example, to assist in better understanding of the operation of the individual blocks;

FIG. 8 is a timing chart illustrating the operation of the individual blocks;

FIG. 9 is a circuit diagram of a service position signal generator associated with the elevator car No. 1, and such circuit is required for each of the remaining elevator cars;

FIG. 10 is a circuit diagram of part of a drive control unit associated with the elevator car No. 1, and such circuit is required for each of the remaining elevator cars;

FIG. 11 is a circuit diagram of a hall call detecting unit; and

FIG. 12 is a circuit diagram of a hall call re-allotment instruction circuit which instructs re-allotment of a hall call fixedly allotted already to an elevator car to another;

FIGS. 14 to 17 show the practical form and operation of the individual blocks in the block diagram shown in FIG. 3 except those explained already with reference to the first embodiment, wherein:

FIG. 14 is a timing chart illustrating the operation of the second embodiment;

FIG. 15 is a circuit diagram of a signal converter;

FIG. 16 is a circuit diagram of a signal selecting unit; and

FIG. 17 is a circuit diagram of a modification of the signal converter shown in FIG. 15;

FIGS. 18 to 21 show still another embodiment of the present invention, wherein:

FIG. 18 is a circuit diagram of a partial modification of the hall call allotting control unit shown in FIG. 6;

FIG. 19 is a circuit diagram of another partial modification of the hall call allotting control unit shown in FIG. 6;

FIG. 20 is a circuit diagram of a modified hall call reset signal generator; and FIG. 21 is a timing chart illustrating the operation of the hall call reset signal generator shown in FIG. 20.

Figure 1:
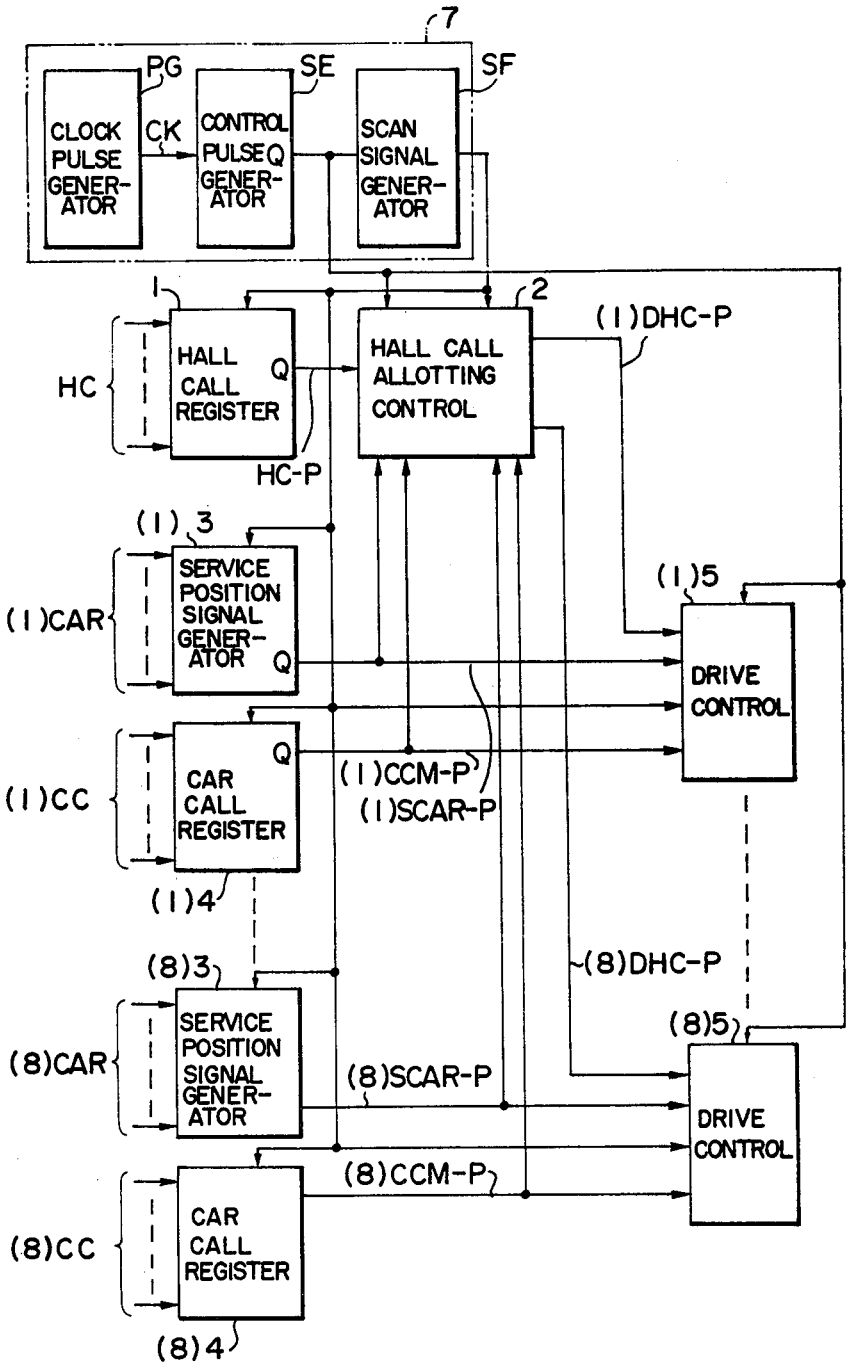
FIG. 1 is a block diagram illustrating schematically the general structure of a preferred embodiment of the elevator control system according to the present invention.

The elevator control system according to the present invention will now be described in detail with reference to the drawing showing an application of the present invention to the allotting control of eight elevator cars Nos. 1 to 8 arranged for parallel operation to service the entire floor range for a building with seven floors aboveground plus one floor underground. It is supposed that the floor interval between the 1st and 2nd floors is about two times that between the other floors. In this specification, the term "elevator car service position" is used throughout to designate such a position which does not represent the actual physical position (synchronous position) of the elevator car but represents the position (advanced position) of the elevator car advanced from the synchronous position by the distance required for the deceleration and stopping of the elevator car which is running, while also taking into account the running direction of the elevator car. The term "service load" is used throughout to designate the basic factor used for the selection of an elevator car to service a hall call. Practically, a "service load" signal is thus variable depending on the length of time required for an elevator car to arrive at the specific floor originating the hall call and also on the running state of the elevator car.

Referring now to the drawing, FIG. 1 is a block diagram showing the general structure of a first preferred embodiment of the elevator control system according to the present invention.

Referring to FIG. 1, a signal generating unit 7 comprises a clock pulse generator PG which generates a train of clock pulses CK. A control pulse generator SE connected to the clock pulse generator PG divides the frequency of the clock pulse signal CK and applies its output to a scan signal generator SF. The output of the control pulse generator SE includes pulses used for synchronization of signals transmitted in time division fashion and pulses used for converting the number of floors run by each of the elevator cars and the number of stops instructed by hall and car calls into, for example, the service load. Such output of the control pulse generator SE is applied to a hall call allotting control unit 2 and individual elevator car drive control units 5, in addition to the scan signal generator SF.

The scan signal generator SF generates a scan signal output in response to the application of the output of the control pulse generator SE and applies this scan signal output to the hall call allotting control unit 2 to provide scan slots used for the hall call allotting control carried out in time division fashion. This scan signal output is also applied to a hall call detector 1 which detects hall calls originated from the floors and divides them with respect to time. Further, the scan signal output is applied to service position signal generators 3 and car call registers 4 associated with the individual elevator cars. The symbol (i) is affixed to the head of the reference numerals and characters representing various units and signals so as to identify that these units and signals are associated with the elevator car No. i (i=1, 2, 3, . . . 8).

In each of the scan slots, a pulse signal HC-P representing detected hall calls is applied from the hall call detector 1 to the hall call allotting control unit 2 together with pulse signals SCAR-P appearing from the service position signal generators 3 to represent the service positions of the individual elevator cars and with pulse signals CCM-P appearing from the car call registers 4 to represent the car calls registered in the individual elevator cars. In response to the application of the pulse signal HC-P representing the detected hall calls, the hall call allotting control unit 2 selects one of the elevator cars suitable for servicing the hall call corresponding to the specific scan slot and applies a hall call allotting pulse signal DHC-P to the drive control unit 5 associated with the selected elevator car to allot this hall call to the selected elevator car. However, when none of the elevator cars are capable of providing quick service for this hall call that is, when the service loads of all the elevator cars exceed a limit, or when all the elevator cars are busy, this hall call may be temporarily held from being allotted to the selected elevator car, or such hall call may be re-allotted to another elevator car. In this manner, the units 1, 2, 3 and 4 operate synchronously in the successive scan slots of the scan signal output of the scan signal generator SF to process hall calls in time division fashion, and the elevator car drive control units 5 control the operation of the individual elevator cars depending on up hall calls and down hall calls. The elevator control system shown in FIG. 1 is therefore advantageous in that it can reliably operate without being substantially affected by the number of service floors and it is compact in construction and inexpensive. Further, due to the fact that a very small number of signal transmission lines are required for the transmission of binary-coded scan signals and pulse signals serialized by the binary-coded scan signals among the units 1, 2, 3, 4 and 5, the number of signal transmission lines can be greatly reduced to improve the reliability, and the period of time required for wiring and the cost thereof can also be greatly reduced. Of course, no electronic computer is required in the elevator control system of the present invention.

Practical forms of the individual blocks shown in FIG. 1 will be described in order.

At first, one practical form and operation of the signal generating unit 7 comprising the clock pulse generator PG, control pulse generator SE and scan signal generator SF will be described with reference to a circuit diagram of FIG. 2 timing charts of FIGS. 3A, 3B, 8, and an elevator state diagram of FIG. 7.

Figure 2:
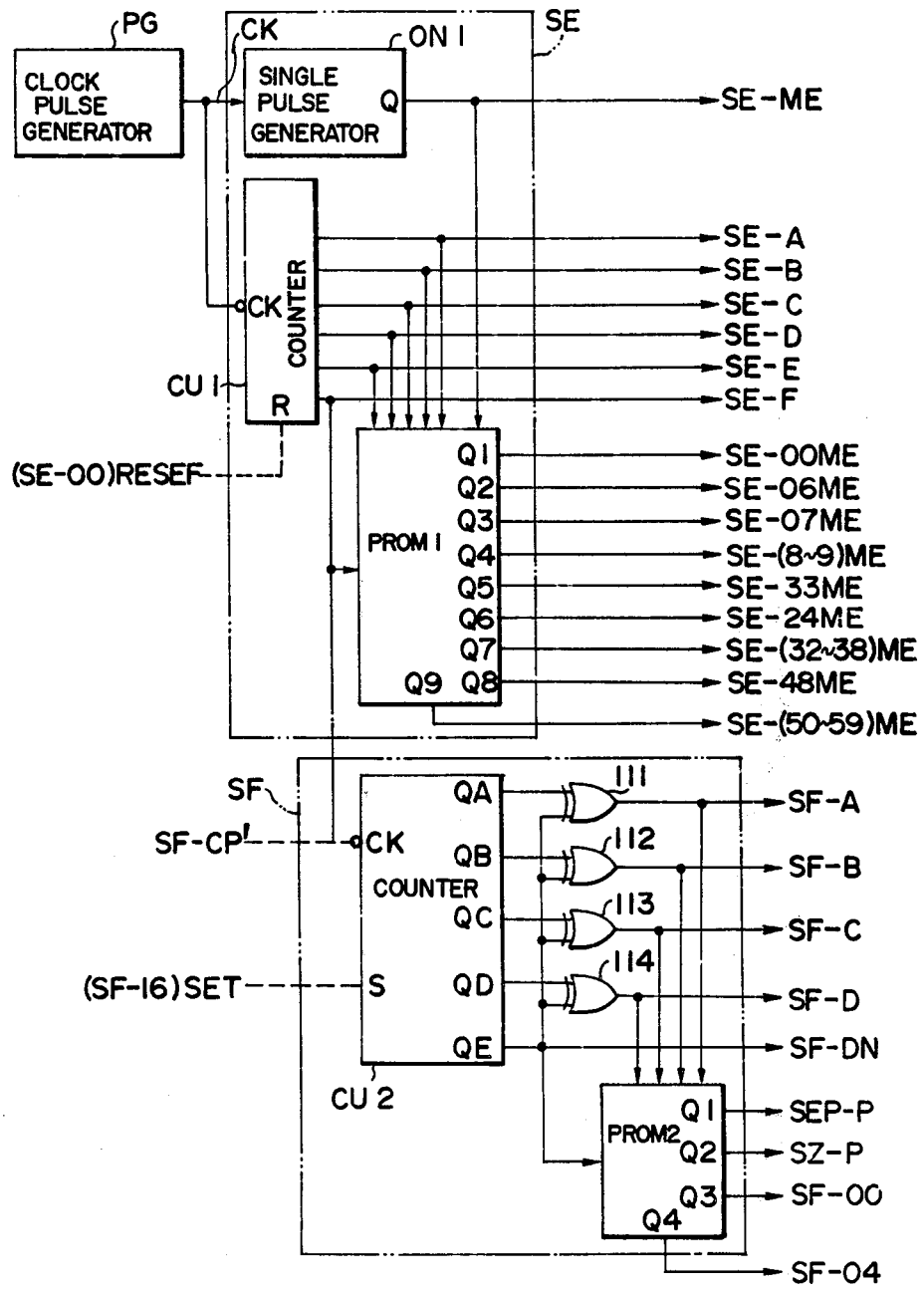

Referring to FIG. 2, the control pulse generator SE includes a counter $CU_1$ which divides the frequency of the clock pulse output CK of the clock pulse generator PG to provide binary-coded control signals SE-A to SE-F used for equally dividing each slot of the scan signal SF into sixty-four SE slots.

The clock pulse output CK of the clock pulse generator PG is also applied to a single pulse generator $ON_1$ to obtain a control pulse signal SE-ME. Each pulse in this signal SE-ME serves also as a so-called strobe pulse. In other words, this control pulse signal SE-ME has also the function of preventing trouble due to, for example, delayed signal transmission during change-over of the binary-coded control signals SE-A to SE-F.

The binary-coded control signals SE-A to SE-F are applied together with the control pulse signal SE-ME to a programmable read-only memory $P{\cdot}ROM_1$ (abbreviated hereinafter as a memory $P{\cdot}ROM_1$), and various control pulse signals SE-OOME to SE-(50–59)ME processed according to a pre-set program appear at respective output terminals $Q_1$ to $Q_9$ of the memory $P{\cdot}ROM_1$.

Such a memory is used so that changes in the factors such as the rated speed of elevator cars, the average interval between the floors of a building, and the mode of traffic demand due to a change in the character of the rooms of the building can be easily dealt with by merely altering the pre-set program in the memory $P{\cdot}ROM_1$ without the need for altering the circuit arrangement of the hall call allotting control unit 2. Gate circuits or the like may be used for this purpose.

Figure 3A:
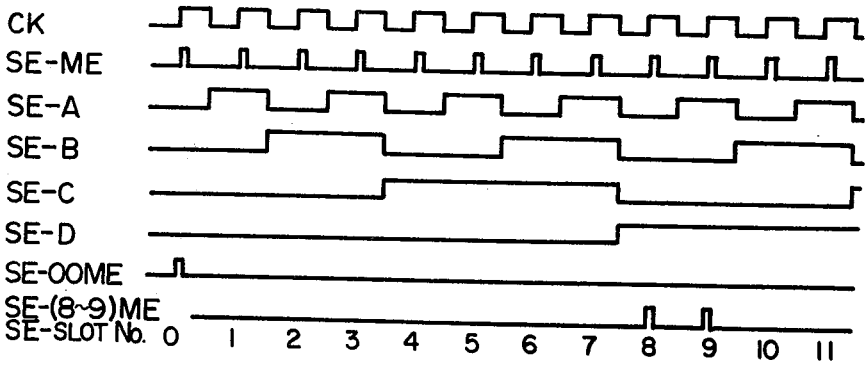
FIGS. 3A and 3B are timing charts illustrating principally the operation of the elements shown in FIG. 2, with the scale of FIG. 3B being reduced compared with that of FIG. 3A.

According to the pre-set program, the control pulse signal SE-OOME appears at the output terminal $Q_1$ of the memory $P{\cdot}ROM_1$ and includes a single pulse appearing at the beginning of each slot of the scan signal SF as shown in FIG. 3A.

According to this pre-set program, the control pulse signal SE-(8–9)ME appears at the output terminal $Q_4$ of the memory $P{\cdot}ROM_1$ and includes one pulse in each of the SE slots Nos. 8 and 9, that is, two pulses in each slot of the scan signal SF as also shown in FIG. 3A. Also, the pre-set program is such that the control pulse signal SE-48ME appears at the output terminal $Q_8$ of the memory $P{\cdot}ROM_1$ and includes a single pulse in the latter half of each slot of the scan signal SF, that is, in the SE slot No. 48 as shown in FIG. 3A. The control pulse signals SE-C and SE-D shown in FIG. 3B are the same as those shown in FIG. 3A, but the former are shown in reduced scale compared with the latter. Practical uses of these control pulse signals will be described later.

The binary-coded control signal SE-F is applied from the counter $CU_1$ to another counter $CU_2$ to be subjected to frequency division, and outputs appearing at output terminals OA to OD of this counter $CU_2$ are passed through exclusive-OR gates 111 to 114 (abbreviated hereinafter as E·OR gates) to provide binary-coded scan signals SF-A to SF-D respectively. These signals have waveforms as shown in FIG. 8. Another binary-coded scan signal SF-DN appearing at another output terminal OE of the counter $CU_2$ is applied as the other input to those E·OR gates 111 to 114 and has a waveform as shown in FIG. 8.

The binary-coded scan signals SF-A to SF-DN are applied to another memory $P{\cdot}ROM_2$ which is programmed to provide a remote floor calling pulse signal SEP-P, a service zone pulse signal SZ-P, a slot pulse signal SF-OO corresponding to the SF scan slot No. 0, and a slot pulse signal SE-O4 corresponding to the SF scan slot No. 4. Signals shown by the dotted lines in FIG. 2 are used in a modification described later.

The binary-coded scan signals SF-A to SF-DN provide the scan slots for sequentially scanning the entire floor range of from the 1st basement to the 7th floor above ground in one direction and the other. Up hall calls or down hall calls from the individual floors of the building may be freely allotted to the individual scan slots provided by the scan signals. However, the order of allotment must be such that the floors are scanned cyclically in the up direction and then in the down direction as shown in FIG. 7. When the floor interval between the 1st and 2nd floors is greater than the others as described already, one or more SF scan slots (abbreviated hereinafter as SF slots) may be skipped in allotting the SF slot to the 2nd floor. The precision of hall call allotting control can be generally improved, in a building having non-uniform floor intervals, by allotting the SF slots to the individual floors while skipping a plurality of SF slots at a rate of one SF slot per unit distance.

Figures 7, 8:
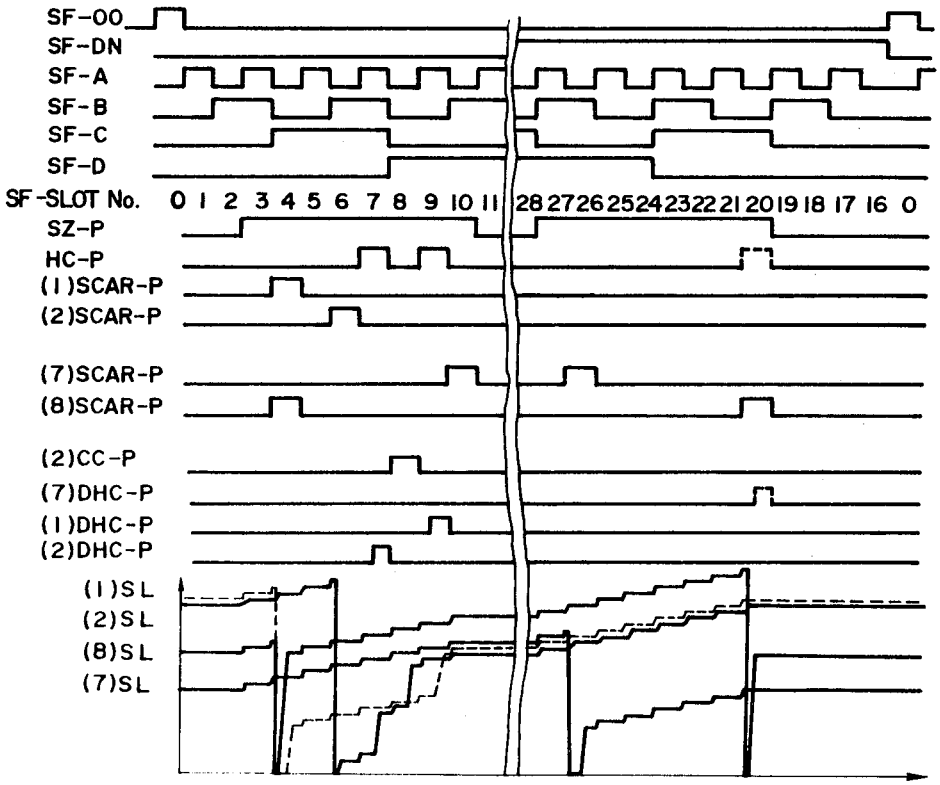

In FIG. 7, an up hall call originated from the 1st basement is shown allotted to the SF slot No. 3, since an application of the elevator control system of the present invention to a building having more underground floors is taken into consideration. The structure of the elevator control system of the present invention remains unchanged even when the 1st basement is allotted to the SF slot No. 0.

Further, although the scan signal generator SF shown in FIG. 2 is applicable to a building having sixteen floors, the scan signal generator SF of the same structure but adapted to provide binary-coded scan signals having an additional two bits can be applied to a building having as many as sixty-four floors.

The E·OR gates 111 to 114 are provided in FIG. 2 so that SF slots can be repeated in the order of Nos. 0, 1, 2, 3, . . . 15, 31, 30, . . . 16, 0, 1, 2, . . . as shown in FIG. 8. By virtue of the above manner of arrangement of the SF slots, an up hall call and a down hall call originated from the same floor are allotted to the SF slots in which the numerical value provided by the binary-coded scan signals SF-A to SF-D representing the lower four bits are the same except the binary-coded scan signal SE-DN representing the most significant bit. Thus, the service position signal generators 3 associated with the individual elevator cars can be used in common for both the up movement and the down movement of the elevator cars and can therefore be simplified in structure.

The memory P·ROM$_2$ of FIG. 2 is programmed so that the service zone pulse signal SZ-P has a high level during the period of from the SF slot No. 3 (allotted to an up hall call originated from the 1st basement) to the SF slot No. 10 (allotted to an up hall call originated from the 6th floor) and during the period of time of from the SF slot No. 27 (allotted to a down hall call originated from the 7th floor) and to the SF slot No. 20 (allotted to a down hall call originated from the 1st floor). That is, this service zone pulse signal SZ-P has a high level during the period of time corresponding to the ranges of the SF slots to which these hall calls originated from the service floors are allotted.

One practical form and operation of the hall call allotting control unit 2 shown in FIG. 1 will be described in detail with reference to FIGS. 4 to 8.

Figure 4:
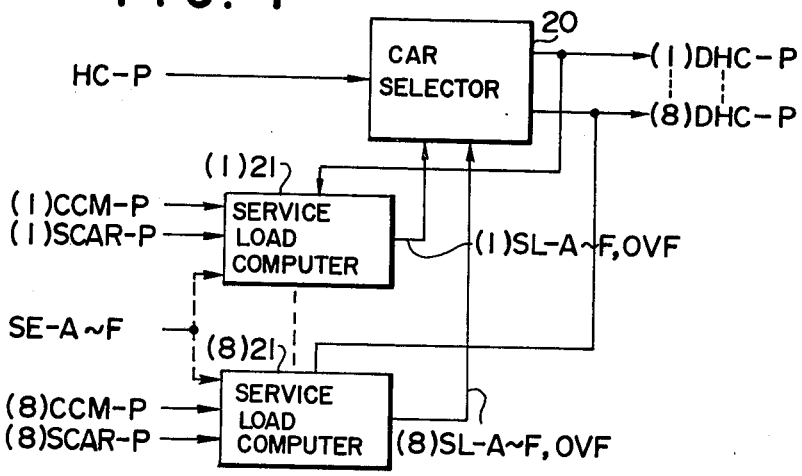

Referring to FIG. 4 which is a block diagram of the hall call allotting control unit 2, this unit 2 comprises an elevator car selecting unit 20 and service load computing units (1)21 to (8)21 associated with the individual elevator cars. In response to the origination of a hall call, the service load computing units (1)21 to (8)21 compute the service loads of the associated elevator cars, and on the basis of the result of the computation, the elevator car selecting unit 20 selects one of the elevator cars most suitable for servicing the hall call and allots the hall call to the selected elevator car. Although the service load computing units (1)21 and (8)21 associated with the elevator cars Nos. 1 and 8 respectively are only shown in FIG. 4, it is apparent that the service load computing units (2)21 to (7)21 associated with the remaining elevator cars Nos. 2 to 7 are similarly provided and shown by the dotted lines.

Each of these service load computing units 21 is reset by the elevator car service position pulse signal SCAR-P and computes in the successive SF slots the number of pulses corresponding to the length of time of delayed service due to the service state of the associated elevator car and the length of time of delayed service due to the stop or acceleration and deceleration of the associated elevator car instructed by the registered car call pulse signal CCM-P or the hall call allotting pulse signal DHC-P. Therefore, the number of pulses computed in each SF slot provides the numerical value corresponding to the length of time required for the elevator car to arrive at the service floor corresponding to the specific SF slot. The elevator car selecting unit 20 selects every SF slot an elevator car which provides a minimum of the outputs SL-A to SL-F and SL-OVF of the elevator car service load computing units 21. The elevator car selecting unit 20 acts then to allot to the selected elevator car the hall call contained in the detected hall call pulse signal HC-P as one of the pulses divided with respect to time by the scan signal SF. The outputs (1)DHC-P to (8)DHC-P of the elevator car selecting unit 20 are the detected hall call pulse signals associated with the elevator cars Nos. 1 to 8 respectively.

Figure 5:
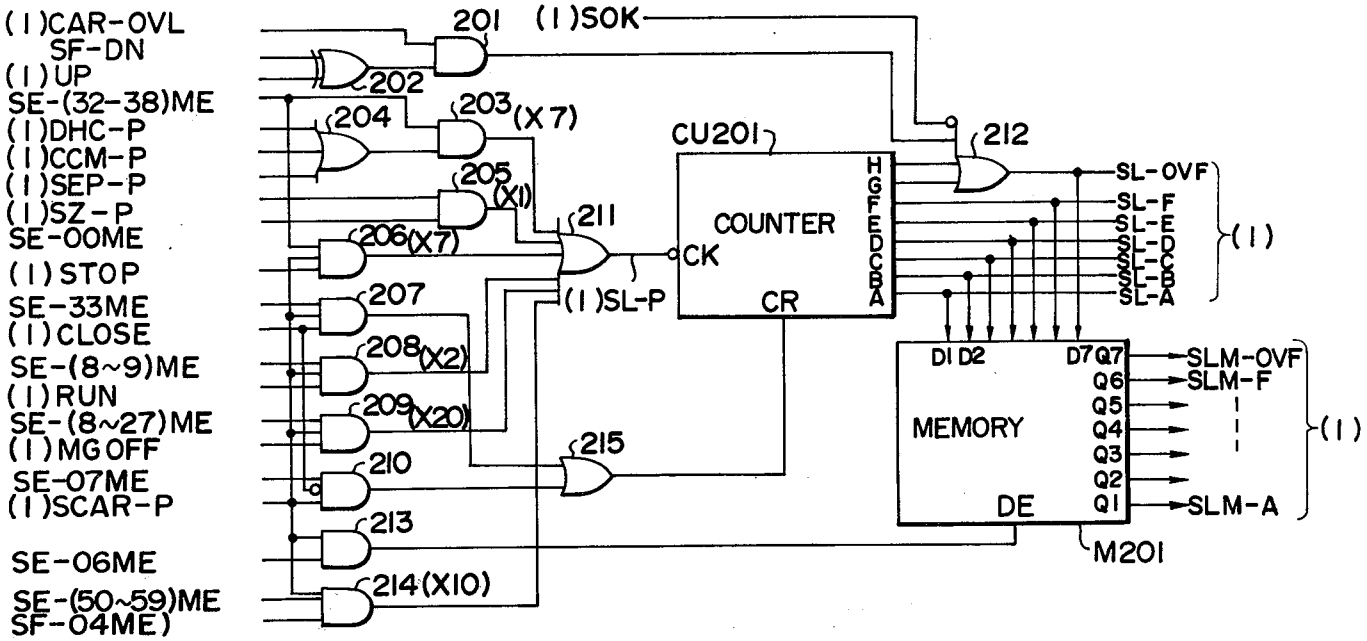

FIG. 5 shows in detail the structure of the service load computing unit (1)21 provided for the elevator car No. 1, and it is apparent that those for the remaining elevator cars Nos. 2 to 8 have a structure similar to that shown in FIG. 5.

Referring to FIG. 5, the service load computing unit (1)21 comprises a counter CU$_{201}$ as an essential part thereof. Gates 203 to 206 and gates 208, 209 are provided to control generation of predetermined numbers of pulses to be counted in the individual SF slots in response to the application of signals representing the service state of the elevator car No. 1. The outputs of gates 203, 205, 206, 208, 209 and 214 are applied to an OR gate 211, and a service load pulse signal SL-P appears from the OR gate 211 to be applied to the count terminal CK of the counter CU$_{201}$. Gates 207 and 210 apply a reset signal to the counter CU$_{201}$ through an OR gate 215.

The symbol (xi) shown on the right-hand side of various gates in FIG. 5 represents the predetermined number of pulses and indicates that the memory P.ROM$_1$ shown in FIG. 2 is programmed to provide i control pulses. That is, the control pulse signals SE-OOME to SE-(50–59)ME are applied to the counter CU$_{201}$ to compute the service load of the elevator car No. 1 in each SF slot on the basis of the service state of this elevator car.

In the form shown in FIG. 5, nine signals described below are applied to the service load computing unit (1)21 as information representative of the service state of the elevator car No. 1.

1. DHC-P: Hall call allotting pulse signal contained pulses divided with respect to time by scan signal
2. CCM-P: Registered car call pulse signal containing pulses divided with respect to time by scan signal
3. SEP-P: End floor or remote floor calling pulse signal containing pulses divided with respect to time by scan signal
4. SZ-P: Service zone pulse signal containing pulses divided with respect to time by scan signal 5. SCAR-P: Elevator car service position pulse signal containing pulses divided with respect to time by scan signal 6. STOP: Elevator car stop signal 7. CLOSE: Elevator car departure preparation (door close) signal 8. RUN: Elevator car run signal 9. MGOFF: Elevator car shutdown signal (This signal is generated when, for example, the elevator car driving Ward-Leonard system is not in operation and the elevator car is unable to start to run immediately.)

However, the service state representing signals are in no way limited to those specified above, and any other suitable signals may be employed in lieu thereof except the service zone signal pulse signal SZ-P. Further, a signal representing the load carried by the elevator car or a signal representing the running speed of the elevator car may be additionally employed to further improve the precision of service load detection.

A car overload signal (1)CAR-OVL appears when the elevator car No. 1 is full loaded, and this signal CAR-OVL is applied to an AND gate 201. Thus, when the scanning direction and the elevator car running direction are the same, and the signal CAR-OVL is generated in an SF slot, an E.OR gate 202 applies its output of high level to the AND gate 201 to turn on the same. As described previously, the binary-coded scan signal SF-DN has a high level and a low level respectively when the scanning direction is upward and downward. An up run signal (1)UP has a high level and a low level respectively when the elevator car No. 1 is running upward and downward. Therefore, the output of the E.OR gate 202 has a high level when the scanning direction and the elevator car running direction are the same. A service OK signal (1)SOK has a high level when the elevator car No. 1 is serviceable and has a low level when this elevator car is not serviceable. These signals are applied to an OR gate 212. Thus, an output SL-OVF of high level appears from this gate 212 when the output of the gate 201 is applied thereto, or when the count of the counter $CU_{201}$ exceeds a predetermined value, or when the service OK signal (1)SOK of low level is applied thereto. The output signal SL-OVF appears from the gate 212 in such a case to indicate the fact that the service load of the elevator car No. 1 exceeds the predetermined limit, and the elevator car No. 1 is no more capable of servicing hall calls.

The gate 210 determines the reset timing of the counter $CU_{201}$ in response to the application of the elevator car service position pulse signal (1)SCAR-P. Taking into account possible delayed transmission of the signal (1)SCAR-P due to the mounting of the hall call allotting control unit 2 and service position signal generator 3 on separate control boards, the control pulse signal SE-07ME occurring slightly after the changeover of one SF slot to the next is applied to the gate 210 to provide a time margin which ensures reliable resetting of the counter $CU_{201}$. When the door of the elevator car No. 1 starts to close to prepare for departure, the door close signal (1)CLOSE of high level is applied to the gate 207 so as to reset the counter $CU_{201}$ with the timing slower than the reset timing provided by the gate 210.

A memory $M_{201}$ reads and stores the count of the counter $Cu_{201}$ existing immediately before it is reset. This is, in response to the application of the service position pulse signal (1)SCAR-P and the control pulse signal SE-06ME to a gate 213, an output appears from the gate 213 to be applied to the memory $M_{201}$, so that the memory $M_{201}$ reads and stores the count of the counter $CU_{201}$ existing immediately before the counter $CU_{201}$ is reset by the output of the gate 215 appearing in response to the application of the control pulse signal SE-07ME to the gate 210 or the control pulse signal SE-33ME to the gate 207. The binary-coded service load output signals (1)SL-A to (1)SL-F of the counter $CU_{201}$ are thus representative of the numerical value proportional to the length of time required for the elevator car No. 1 to arrive at a floor corresponding to a specific SF slot from the present position of the elevator car No. 1. The practical operation of the service load computing unit (1)21 shown in FIG. 5 will be described in more detail later in conjunction with the operation of the entire control system.

Figure 6:
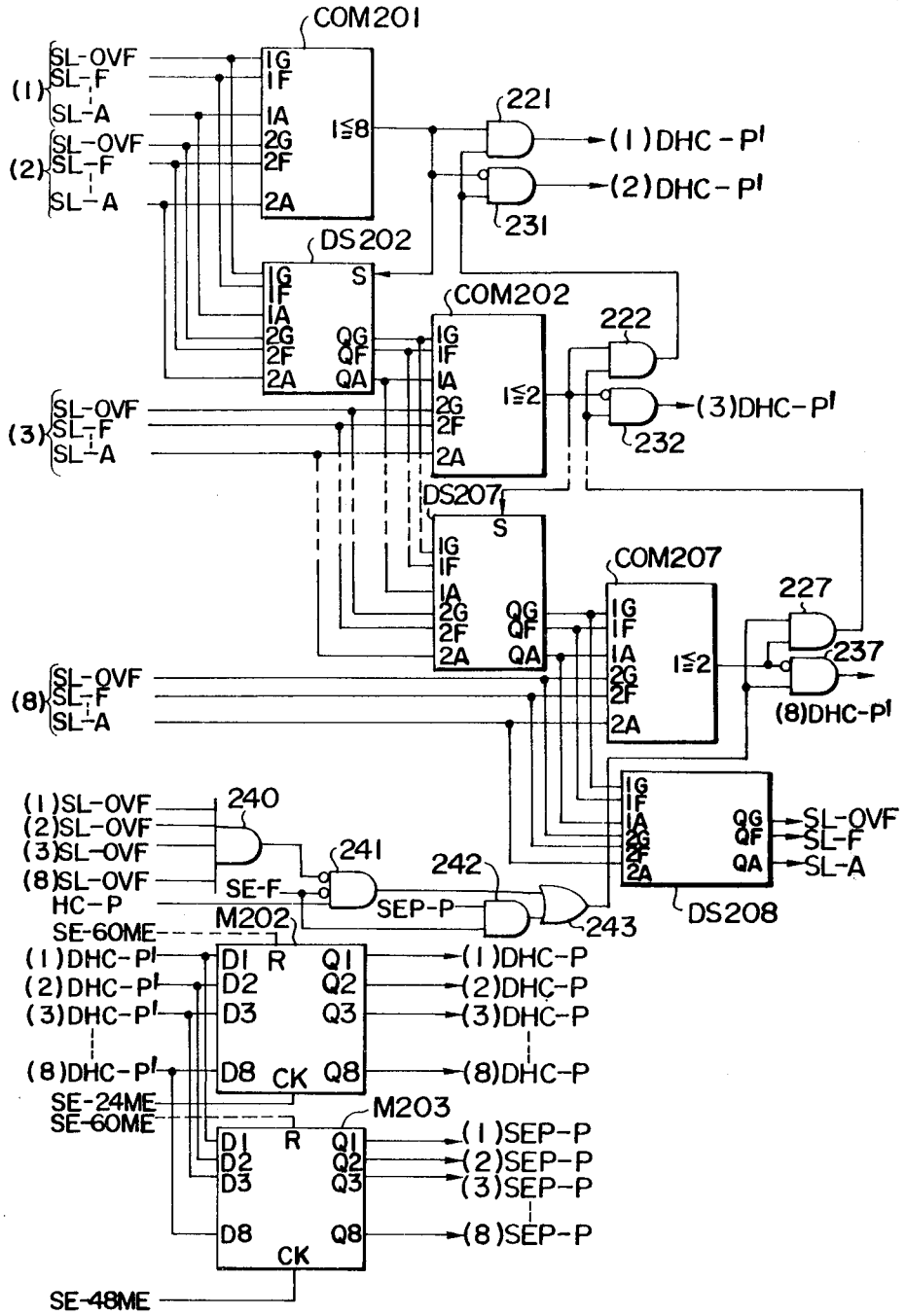

FIG. 6 shows one practical form of the elevator car selecting unit 20 shown in FIG. 4. The binary-coded service load signals SL-A to SL-F and SL-OVF obtained for the individual elevator cars in the manner described with reference to FIG. 5 are applied to the circuit shown in FIG. 6, and an elevator car providing a minimum service load is selected.

At first, the service loads of the elevator cars Nos. 1 and 2 are compared with each other by a first comparator $CM_{201}$. Then, the smaller service load is selected by a first data selector DS202, and this selected service load is compared with that of the elevator car No. 3 by a second comparator $COM_{202}$. In this manner, the service loads are successively compared for the individual elevator cars. The minimum service lead among those of the elevator cars Nos. 1 to 7 is selected by a sixth data selector $DS_{207}$ and is then compared with the service load of the elevator car No. 8 by a seventh comparator $CM_{207}$. A seventh data selector $DS_{208}$ selects the minimum service load among those of all the elevator cars. In FIG. 6, the dotted lines show that the third, fourth, fifth and sixth comparators and the second, third, fourth and fifth data selectors of similar structure are omitted to avoid confusion. The last-mentioned data selector $DS_{208}$ is used in an application of the present invention, and the elevator car selecting unit 20 need not include this specific data selector $DS_{208}$ as an essential part.

The operation of the elevator car selecting unit 20 shown in FIG. 6 will be briefly described with reference to the SF slot No. 7 (corresponding to an up hall call originated from the 3rd floor) in the elevator car state diagram shown in FIG. 7, by way of example. As shown in FIG. 7, it is supposed that the elevator car No. 1 is located at the 1st floor for upward movement, the elevator car No. 7 is located at the 6th floor for downward movement, the elevator car No. 2 is running upward between the 1st and 2nd floors, and the remaining elevator cars Nos. 3 to 6 and 8 are cut off from the power supply.

Referring to FIG. 7, the service load of the elevator car No. 2 is less than that of the elevator car No. 1, and an output of low level appears from the comparator $CM_{201}$ to inhibit a gate 221. At the same time, this comparator output of low level is applied to the select terminal S of the data selector $DS_{202}$ to select the service load of the elevator car No. 2.

The service OK signal SOK in FIG. 5 is of low level in the case of each of the elevator cars Nos. 3 to 6 and 8, since it is supposed in FIG. 7 that these elevator cars are disconnected from the power supply. Therefore, the service load signals SL-OVF associated with these elevator cars Nos. 3 to 6 and 8 have a high level, and the service loads thereof are naturally more than that of the elevator car No. 2. Thus, outputs of high level appear from the comparators $CM_{202}$ to $CM_{205}$. Since the service load of the elevator car No. 7 is more than that of the elevator car No. 2, an output of high level appears from the comparator $CM_{206}$ (not shown), and the service load of the elevator car No. 2 is selected by the data selector $DS_{207}$. The comparator $CM_{207}$ compares the service load of the elevator car No. 2 with that of the elevator car No. 8, and an output of high level appears from this comparator $CM_{207}$, since the former service load is less than the latter.

In FIG. 7, an up hall to be processed in the SF slot No. 7 is originated from the 3rd floor. Thus, the detected hall call pulse signal HC-P has a high level in this SF slot. This detected hall call pulse signal HC-P is transmitted to a gate 231 through gates 241, 243 and 227 to 222. Since an output of low level appears from the comparator $COM_{201}$ as above described, the gate 231 is solely turned on to deliver a hall call allotting signal (2)DHC-P' for allotting the hall call originated from the 3rd floor to the elevator car No. 2.

In response to the application of the control pulse signal SE-24ME in the SF slot No. 7 to a memory $M_{202}$, the output (2)DHC-P' of the gate 231 is stored in this memory $M_{202}$. This signal (2)DHC-P' is applied as a hall call allotting pulse signal (2)DHC-P from the memory $M_{202}$ to the drive control unit (2)5 provided for the elevator car No. 2. In FIG. 6, the memory $M_{202}$ is shown to be reset by the control pulse signal SE-60ME, but it may be reset by any other suitable signal. Thus, appearance of the hall call allotting pulse signal (2)DHC-P from the memory $M_{202}$ in the SF slot No. 7 indicates that the up hall call originated from the 3rd floor is allotted to the elevator car No. 2.

The operation of the hall call allotting control unit 2 described with reference to FIGS. 4 to 8 will be described in a broader aspect on the basis of the elevator car state diagram shown in FIG. 7.

Consider now variations of the service load (1)SL of the elevator car No. 1. This elevator car No. 1 is located at the 1st floor for upward movement, and a stop signal (1)STOP of high level appears in FIG. 5. In such a case, the count of the counter $CU_{201}$ in the service load computing unit (1)21 shown in FIG. 5 varies in a manner as described below.

In the SF slot No. 4 corresponding to an up hall call originated from the 1st floor, the elevator car service position pulse signal (1)SCAR-P has a high level. At the timing at which the control pulse signal SE-07ME turns to a high level, an output of high level appears from the gate 210 to apply a clear pulse to the counter $CU_{201}$ through the gate 215. In response to the application of the control pulse signal SE-(32-38)ME, service position pulse signal (1)SCAR-P and stop signal (1)STOP to the AND gate 206, a train of seven pulses appear from the gate 206 and are applied through the OR gate 211 to the count terminal CK of the counter $CU_{201}$ to be added to the previous count of the counter $CU_{201}$.

At this time, however, the counter $CU_{201}$ associated with the elevator car No. 1 is in the cleared state since an up hall call originated from the 1st floor is allotted to the SF slot No. 4 in which the control pulse signal SE-24ME has a high level. Therefore, if such up hall call were originated from the 1st floor, this up hall call would be allotted preferentially to the elevator car No. 1 before being allotted to another, for example, the elevator car No. 8 standing still in shutdown state at the same floor. As described previously, however, the door close signal (1)CLOSE of high level appears as soon as the door of the elevator car No. 1 starts to close, and the reset timing of the counter $CU_{201}$ is now determined by the gate 207 instead of the gate 210. Thus, the counter $CU_{201}$ is now reset by the control pulse signal SE-33ME and is not reset by the control pulse signal SE-24ME acting as the timing signal used for allotment of the up hall call originated from the 1st floor. Therefore, the up hall call originated from the 1st floor is not allotted to the elevator car No. 1. This manner of reset timing control is effective in preventing opening of the door and delayed dispatch of the elevator car which is ready to dispatch with its door closed.

When now the SF slot No. 4 shifts to the SF slot No. 5, the control pulse signal SE-OOME and the service zone pulse signal SZ-P are applied to the AND gate 205 in FIG. 5, and one pulse of the service load pulse signal (1)SL-P is applied through the gate 211 to the counter $CU_{201}$ to increase the count from "7" to "8". Similarly, the count of the counter $CU_{201}$ increases from "8" to "9" in the SF slot No. 6, and from "9" to "10" in the SF slot No. 7.

On the other hand, the elevator car No. 2 is running upward between the 1st and 2nd floors, and the service position thereof is the 2nd floor in this case. Therefore, the counter $CU_{201}$ associated with the elevator car No. 2 and having a structure similar to that shown in FIG. 5 is cleared once in the SF slot No. 6. Since the run signal (2)RUN of high level is applied to the gate 208, two pulses appear from the gate 208 and are applied to the counter (2)$CU_{201}$ which counts therefore "2". In the next SF slot No. 7, the control pulse signal SE-OOME and the service zone pulse signal SZ-P are applied to the AND gate 205 to increase the count of this counter $CU_{201}$ from "2" to "3". Thus, the service load of the elevator car No. 2 at the 3rd floor is "3" which is less than the service load "10" of the elevator car No. 1, and the up hall call originated from the 3rd floor is allotted to the elevator car No. 2.

The service load of the elevator car No. 1 is "12" in the SF slot No. 9 in which the control pulse signal SE-24ME has a high level. For the up hall call originated from the 5th floor, the elevator car No. 2 provides delayed service, since it must service the up hall call originated from the 3rd floor and the car call for the 4th floor. Thus, a train of seven service load pulses appear from the gate 203, hence the gate 211, for each of the calls to be serviced by the elevator car No. 2 which provides delayed service for the up hall call originated from the 5th floor. These pulses are applied to the counter $CU_{201}$ associated with the elevator car No. 2 to count up the service load of this elevator car to "20". In the SF slot No. 9, the elevator car No. 1 is again the elevator car capable of servicing the up hall call originated from the 5th floor earliest of all, and this up hall call originated from the 5th floor is allotted to the elevator car No. 1. At the same time, in response to the application of the control pulse signal SE-(32-38)ME and hall call allotting pulse signal (1)DHC-P to the AND gate 203, a train of seven pulses appear from this gate 203 and are applied through the gate 211 to the counter $CU_{201}$ associated with the elevator car No. 1 to count up the count to "17".

In the SF slot No. 10, the count of the counter $CU_{201}$ associated with the elevator car No. 1 is increased up to "18" in response to the application of the service zone pulse signal SZ-P to the gate 205. During the period of from the SF slot No. 11 to the SF slot No. 15, no increase occurs in the count of the counter $CU_{201}$ associated with the elevator car No. 1. Similarly, no count-up occurs in this counter $CU_{201}$ during the period of downward scanning in the range of the SF slots Nos. 31 to 28, since the floors corresponding to these SF slots are not included in the service zone.

In the SF slot No. 27 corresponding to a down hall call originated from the 7th floor, the service load of each individual elevator car is counted up by "1". In the SF slot No. 26, the counter $CU_{201}$ associated with the elevator car No. 7 and having a structure similar to that shown in FIG. 5 is cleared, and count-up of the service load from "0" is then started in this counter $CU_{201}$ in the succeeding SF slots. Therefore, a down hall call originated from a lower floor is allotted to the elevator car No. 7 having a service load less than that of the others.

The count of the counter $CU_{201}$ associated with the elevator car No. 1 is "29" when the scan slot cycle returns to the SF slot No. 4 again. In response to the application of the control pulse signal SE-06ME to the gate 213, the binary-coded service load signals (1)SL-A to (1)SL-F are applied to the memory $M_{201}$ to be stored therein.

The numerical values of the service loads (1)SL, (2)SL and (7)SL of the respective elevator cars Nos. 1, 2 and 7 computed in the manner above described vary as shown at the lower part of FIG. 8, in which the horizontal axis represents the SF slot and the vertical axis represents the service load.

The overall elevator car service load can be detected by adding the counts of all the memories $M_{201}$ associated with the individual elevator cars or by counting the number of all the output pulses appearing from the gates 211 associated with the individual elevator cars. This overall elevator car service load may therefore be utilized for classifying the elevator traffic demand onto a non-busy pattern, a busy pattern, an office-going pattern and an office-leaving pattern.

While the operation of the hall call allotting control unit 2 has been described with particular reference to the parts associated with the elevator car No. 1, various points which have not been fully explained above will now be described.

In a relatively non-busy state as shown in FIG. 7, some of the elevator cars are not in operation. Some of them are in a shutdown state, as for example, the elevator car No. 8. In this shutdown state, the Ward-Leonard system is also deenergized. It is therefore preferable not to allot a hall call to such an elevator car for the purpose of power saving. Therefore, in the case of the elevator car No. 8 which has its Ward-Leonard system deenergized as shown by the symbol MGOFF in FIG. 7, it is preferable to increase the service load beyond the value corresponding to the period of time of delayed service required for completely activating the Ward-Leonard system. To this end, the Ward-Leonard shutdown signal MGOFF is applied to the gate 209 in FIG. 5, and a train of twenty service load pulses are applied from the gate 209 to the counter $CU_{201}$ through the gate 211 to add "20" to the count of the counter $CU_{201}$.

In the present specification, the number of pulses in each of the control pulse signals is determined under the assumption that the floor interval is 3.6 meters except that between the 1st and 2nd floors, the elevator car rated speed is 2.5 meters per second, the length of time required for completely opening the door is 1.5 seconds, the length of time required for completely closing the door is also 1.5 seconds, the average length of time required for acceleration is 2 seconds, the average length of time required for deceleration is also 2 seconds, and the total length of delayed service time required for one stop is 10 seconds.

One practical structure and operation of the hall call allotting control unit 2 shown in FIG. 2 has been described in detail hereinbefore.

Practical form of the service position signal generator 3 and elevator car drive control unit 5 required for each individual elevator car will be described in detail with reference to FIGS. 9 and 10. Those shown in FIGS. 9 and 10 are provided for the elevator car No. 1, and it is apparent that the generator 3 and control unit 5 of similar structure are also provided for the remaining elevator cars.

Figure 9:
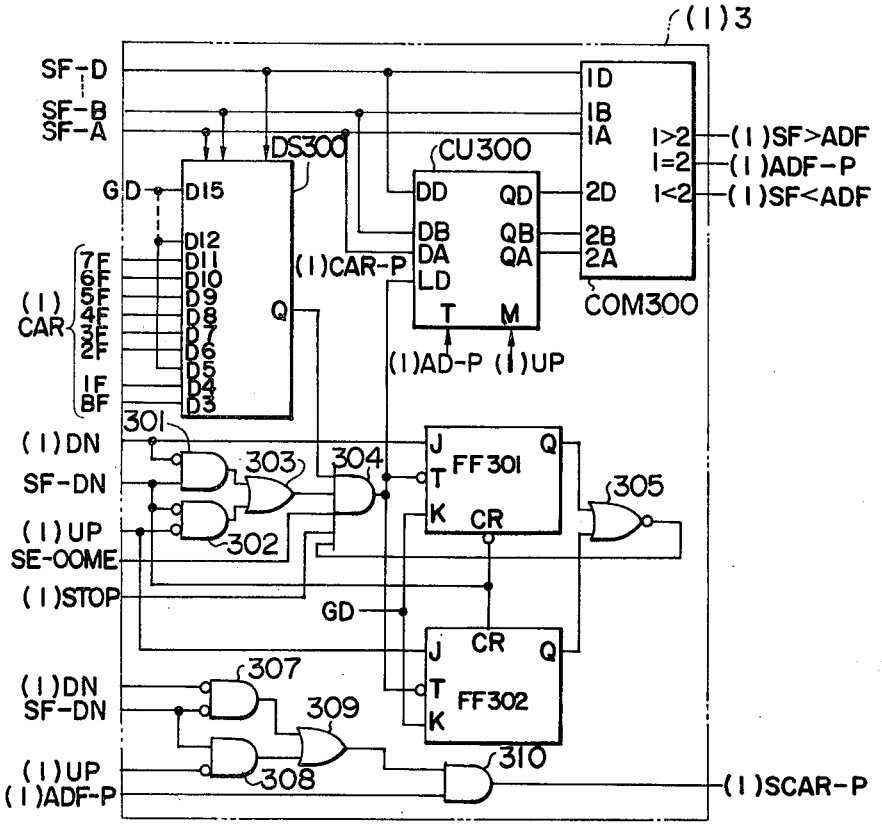
Figure 10:
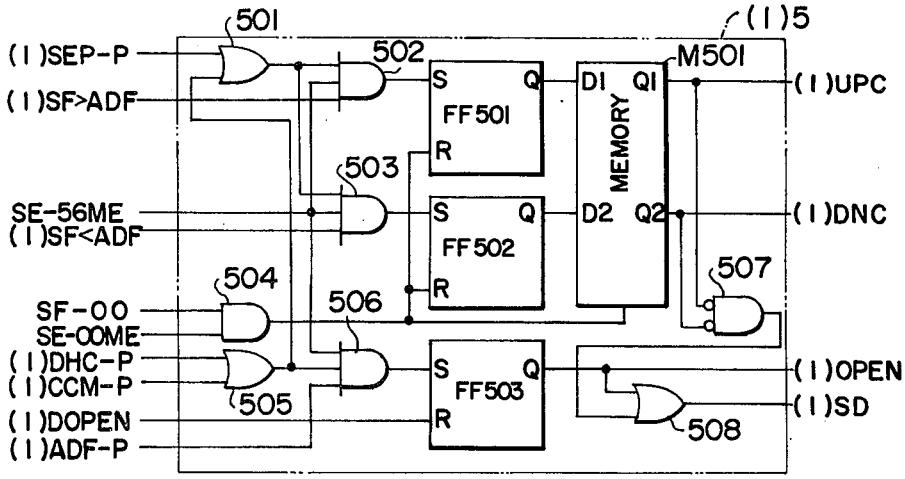

FIG. 9 shows the practical structure of the service position signal generator (1)3 provided for the elevator car No. 1.

Figure 13:
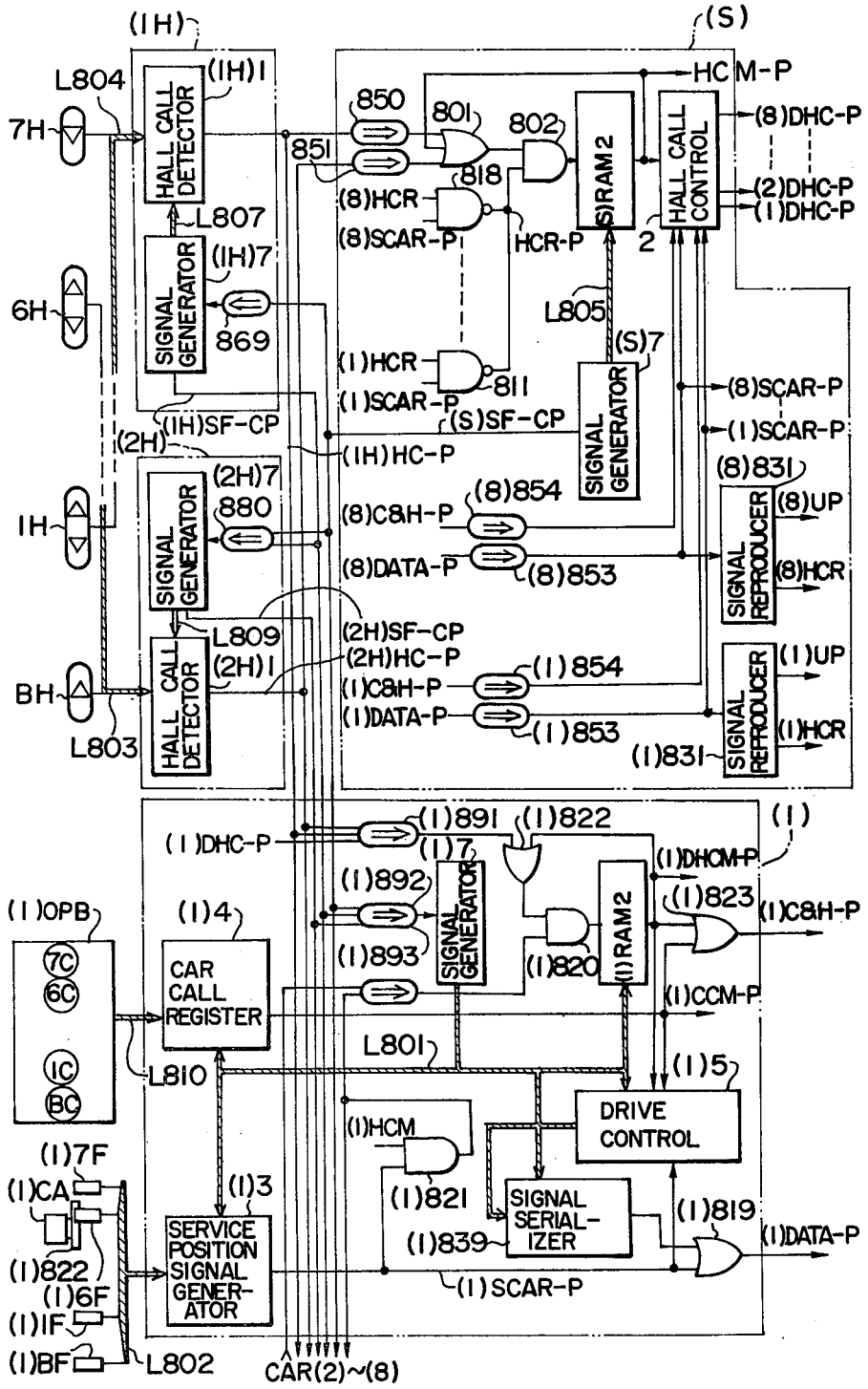
FIG. 13 is a block diagram of another preferred embodiment of the present invention.

Referring to FIG. 9, the service position signal generator (1)3 comprises a data selector $DS_{300}$ having input terminals $D_3$ to $D_{15}$. An input representing the synchronous position of the elevator car No. 1 is applied to one of the input terminals $D_3$, $D_4$ and $D_6$ to $D_{11}$ of the data selector $DS_{300}$ from a circuit shown in FIG. 13. Referring to FIG. 13, a detected element (for example, a shielding plate) (1)822 is fixed to the car body (1)CA, and a plurality of position detectors (1)BF to (1)7F are fixed in vertically spaced apart relation to the wall of the shaft opposite to the detected element (1)822. These position detectors (1)BF to (1)7F may comprise a combination of a permanent magnet and a reed relay disposed opposite to each other so that the relay contact may be turned on in response to the movement of the shielding plate (1)822 relative to the relay. In the manner above described, the position detectors (1)BF to (1)7F detect the synchronous position of the elevator car No. 1.

In response to the application of the elevator car synchronous position signal (1)CAR and the binary-coded scan signals SF-A to SF-D in the successive SF slots, the data selector $DS_{300}$ detects the synchronous position of the elevator car No. 1, and a pulse signal (1)CAR-P representing the synchronous position of the elevator car No. 1 appears from the data selector $DS_{300}$. This synchronous position pulse signal (1)CAR-P is applied to a gate 304, and an output of high level appears from the gate 304 to be applied to a preset data read control terminal LD of a counter $CU_{300}$ associated with the elevator car No. 1. The same scan signals SF-A to SF-D as those applied to the data selector $DS_{300}$ are applied to preset data input terminals DA to DD respectively of this counter $CU_{300}$. Therefore, when the elevator car No. 1 is located at the 1st floor for upward movement as shown in FIG. 7, and the SF slot shifts to No. 3 to No. 4 to turn the control pulse signal SE-OOME to its high level, the count of the counter $CU_{300}$ is set at "4" to indicate that the elevator car No. 1 is located at the 1st floor.

When this elevator car No. 1 starts to run in either direction, it can only respond to a hall call originated from a floor lying in the advancing direction beyond the synchronous position of the elevator car by the distance required for deceleration. Therefore, an advanced position pulse signal (1)AD-P is applied to the counter $CU_{300}$ as soon as the elevator car No. 1 starts to run thereby counting up (or down) the count of the counter $CU_{300}$. The resultant count of the counter $CU_{300}$ represents the numerical value indicating the advanced position of the elevator car No. 1 advanced beyond the synchronous position thereof. This manner of computing the advanced position of the elevator car advanced beyond its synchronous position is well known in the art. Thus, the advanced position pulse signal (1)AD-P is, for example, a pulse signal consisting of a train of pulses appearing at predetermined time intervals after the elevator car starts to run and until a stop-demanding call is detected.

The elevator car synchronous position pulse signal (1)CAR-P detected in the manner above described and the resultant count of the counter $CU_{300}$ do not take the running direction of the elevator car No. 1 into account. Therefore, this synchronous position pulse signal (1)CAR-P is independent of the running direction and is generated each time the binary-coded scan signals SF-A to SF-D representing the lower four bits provides the SF slot corresponding to the synchronous position of the elevator car No. 1, and the numerical value provided by these signals SF-A to SF-D at that time is set in the counter $CU_{300}$. As described previously, the binary-coded scan signals SF-A to SF-D represent the lower four bits which represent the same floor in both the period of up hall call scanning and the period of down hall call scanning when they provide the same numerical value in each case, and the direction of scanning is determined by the binary-coded scan signal SF-DN which represents the most significant bit.

Flip-flops $FF_{301}$ and $FF_{302}$ and gates 301 to 305 are provided in FIG. 9 so that the position detection can be properly attained even when, for example, the elevator car No. 1 is forced to stop between the 2nd and 3rd floors due to interruption of power supply or any other cause. The synchronous position pulse signal (1)CAR-P of high level continues to appear from the data selector $DS_{300}$ in the SF slots Nos. 6 and 7 in the event the elevator car No. 1 is forced to stop between the 2nd and 3rd floors. However, the gate 302, for example, is inhibited by the signal (1)UP of high level appearing when the elevator car No. 1 is instructed to run upward in response to an up hall call. Thus, the synchronous position pulse signal (1)CAR-P is allowed to be applied to the read control terminal LD of the counter $CU_{300}$ only when the binary-coded scan signal SF-DN remains in its high level, that is, during the period of down hall call scanning.

In the SF slot No. 23, the numerical value provided by the binary-coded scan signals SF-A to SF-D representing the lower four bits is equal to that in the SF slot No. 7. In this SF slot No. 23, the gate 304 applies the synchronous position pulse signal (1)CAR-P to the counter $CU_{300}$ to set "7" therein, and at the same time, the output appearing from the output terminal Q of the flip-flop $FF_{302}$ is changed over from the previous low level to the high level thereby inhibiting the gate 304 through the gate 305. Thus, application of the synchronous position pulse signal (1)CAR-P to the counter $CU_{300}$ in the next SF slot No. 22 is inhibited, and the count "7" corresponding to the an up hall call originated from the 3rd floor remains in the counter $CU_{300}$. According to such manner of control, the elevator car No. 1 is assumed to be located at the 3rd floor which is advanced relative to the present location between the 2nd and 3rd floors, since the elevator car No. 1 is unable to run at the normal speed from such a position to respond to the hall call originated from the 3rd floor.

The binary-coded advanced position information set in the counter $CU_{300}$ in this manner is applied from output terminals QA to QD to input terminals 2A to 2D of a comparator $COM_{300}$. The binary-coded scan signals SF-A to SF-D representing the lower four bits are applied to input terminals 1A to 1D of the comparator $CM_{300}$ to be compared with the inputs applied to the input terminals 2A to 2D. When the information applied to the input terminals 1A to 1D provides a value larger than that applied to the input terminals 2A to 2D, a signal (1)SF>ADF appears from the comparator $CM_{300}$, while when the former is smaller than the latter, a signal (1)SF<ADF appears from the comparator $CM_{300}$. An advanced position signal (1)ADF-P in pulse signal form appears from the comparator $CM_{300}$ when the information applied to the input terminals 1A to 1D coincides with that applied to the input terminals 2A to 2D.

The advanced position pulse signal (1)ADF-P is independent of the running direction of the elevator car No. 1. This advanced position pulse signal (1)ADF-P is applied together with the up run signal (1)UP or the down run signal (1)DN and the scan signal SF-DN to a gate circuit consisting of a plurality of gates 307 to 310 so as to be converted into the service position pulse signal (1)SCAR-P in which the running direction of the elevator car No. 1 is taken into account. Suppose, for example, that the elevator car No. 1 is located for upward movement (in which case, the signals (1)UP and (1)DN are of high and low levels respectively), and the direction of scanning is upward (in which case, the scan signal SF-DN has a low level). In response to the appearance of the advanced position pulse signal (1)ADF-P in such a case, an output of high level appears from the gate 307, and the service position pulse signal (1)SCAR-P appears from the gate 310. Even when the advanced position pulse signal (1)ADF-P appears during the period of downward scanning (in which case, the scan signal SF-DN has a high level), the outputs of both the gates 307 and 308 are of low level, and the service position pulse signal (1)SCAR-P would not appear. Thus, the service position pulse signal (1)SCAR-P represents the advanced position of the elevator car No. 1 in which the running direction is taken into account.

FIG. 10 shows one practical form of a run signal detecting section of the drive control unit (1)5 provided for the elevator car No. 1 for producing an up run call signal (1)UPC, a down run call signal (1)DPC, a door open signal (1)OPEN and a deceleration instruction signal (1)SD in response to the application of various call signals of pulse signal form.

The inputs to the circuit shown in FIG. 10 include the output of the comparator $CM_{300}$ shown in FIG. 9, the hall call allotting pulse signal (1)DHC-P applied from the hall call allotting control unit 2, the remote floor calling pulse signal (1)SEP-P, the registered car call pulse signal (1)CCM-P applied from the car call register (1)4, the control pulse signals SF-00, SE-OOME and SE-56ME applied from the control signal generating unit 7, and the door open start signal (1)DOPEN.

Referring to FIG. 7, an up hall call originated from the 5th floor in allotted to the elevator car No. 1. Referring to FIG. 8, the hall call allotting pulse signal (1)DHC-P has a high level in the SF slot No. 9, in such a case.

Since the advanced position of the elevator car No. 1 is the 2nd floor, the output signal (1)SF>ADF of the comparator $COM_{300}$ in FIG. 9 has a high level. This means that the value provided by the information applied to the input terminals 1A to 1D of the counter $CU_{300}$ is larger than that applied to the input terminals 2A to 2D, and the scan signals SF-A to SF-D are processing the floors above the advanced position of the elevator car No. 1. The hall call allotting pulse signal (1)DHC-P is applied through gates 505 and 501 to an AND gate 502 to which the signals (1)SF>ADF and SE-56ME are applied. An output of high level appears from the AND gate 502 to set a flip-flop $FF_{501}$.

The control pulse signal SE-56ME applied to the gate 502 as one input is a timing control pulse commonly called a strobe pulse. In FIG. 10, the gate 502 is opened for a short period of time upon complete transmission of the hall call allotting pulse signal (1)DHC-P from the hall call allotting control unit 2 together with the remote floor calling pulse signal (1)SEP-P, and the output of the gate 502 appearing during this short period of time is used to set the flip-flop $FF_{501}$. Therefore, faulty operation due to an error of signal transmission timing tending to occur at the time of SF slot change-over, as well as faulty operation owing to noises tending to be mixed during signal transmission, can be completely avoided to ensure reliable operation of the flip-flop $FF_{501}$.

Upon completion of the SF scan cycle, the control pulse signal SF-00 of high level is applied to a gate 504, and an output of high level appears from this gate 504. A memory $M_{501}$ reads the data stored in the flip-flop $FF_{501}$, and at the same time, the flip-flop $FF_{501}$ is reset. This memory $M_{501}$ reads the data input during the rise time of the signal applied to its input terminal T.

Then, when the control pulse signal SE-56ME takes a high level again in the SF slot No. 9, the flip-flop $FF_{501}$ is set again, and the data stored in this flip-flop $FF_{501}$ is registered in the memory $M_{501}$ at the beginning of the next SF scan cycle at which the control pulse signal SF-00 takes the high level again. Therefore, an output of high level or the up run call signal (1)UPC appears continuously from the memory $M_{501}$ to cause running of the elevator car No. 1 upward until the advanced position of the elevator car No. 1 reaches the 5th floor from which the up hall call is originated or this hall call is re-allotted to another elevator car.

When the advanced position of the elevator car No. 1 reaches the 5th floor corresponding to the SF slot No. 9, the signal (1)SF>ADF disappears, and the advanced position pulse signal (1)ADF-P of high level appears to be applied through a gate 506 to another flip-flop $FF_{503}$ to set the same. The deceleration instruction signal (1)SD and the door open signal (1)OPEN appear from a gate 508 and flip-flop $FF_{503}$ respectively, with the result that the advanced position detection is not carried out any more, and the elevator car No. 1 is ready to decelerate and open the door. The flip-flop $FF_{503}$ is reset by the door open start signal (1)DOPEN which appears when the door starts to open after the elevator car No. 1 is stopped completely.

The drive control unit 5 provided for each elevator car includes many other means for carrying out the door open-close control, speed control, maintenance run control, running direction determination, reset signal generation, etc. However, these means will not be described herein as they have not direct concern with the present invention.

Practical form of the hall call detector 1 and car call registers 4 will be described in detail with reference to FIG. 11.

Figure 11:
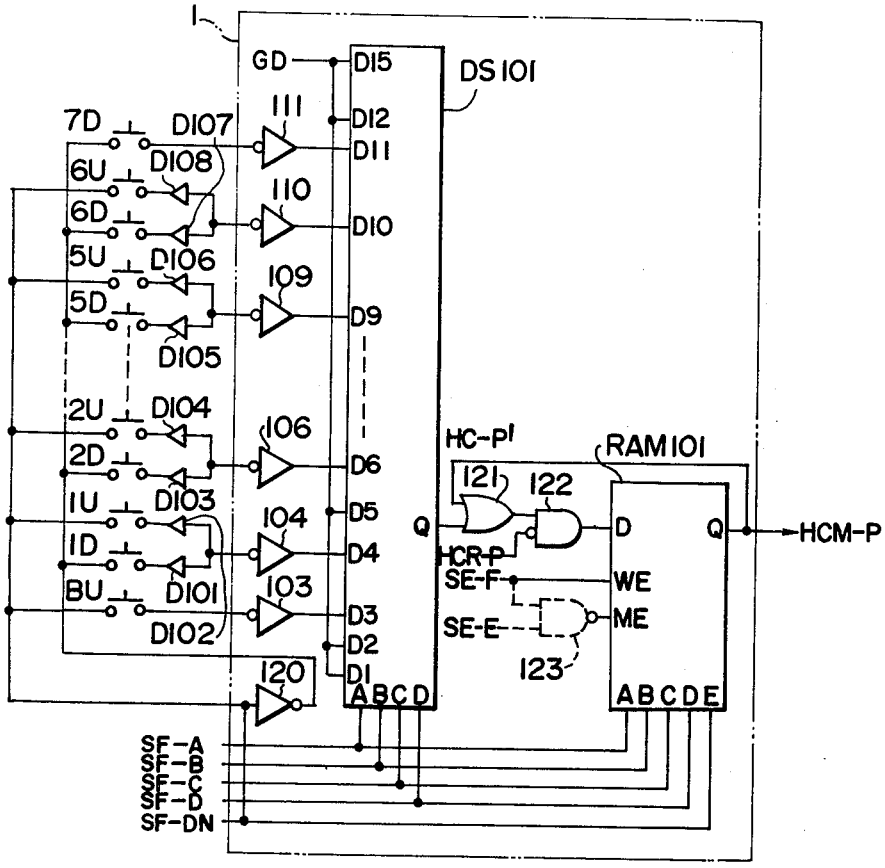

Referring to FIG. 11, the left-hand side terminals of up hall call buttons BU and 1U to 6U and down hall call buttons 1D to 7D disposed at the individual floors are connected to an input terminal and an output terminal respectively of a gate 120. The scan signal SF-DN is also connected to the input terminal of the gate 120. The right-hand side terminals of the hall call buttons BU, 1U to 6U, and 1D to 7D are classified by the floors to be connected through gates 103 to 111 to data input terminals D3 to D11 of a data selector $DS_{101}$ respectively as shown.

The binary-coded scan signals SF-A to SF-D representing the lower four bits are connected to select input terminals A to D respectively of the data selector $DS_{101}$. Therefore, this data selector $DS_{101}$ operates in a manner similar to the data selector $DS_{300}$ shown in FIG. 9, so that the data applied to one of the data input terminals $D_3$ to $D_{11}$ is selected in each SF slot to appear at its output terminal Q.

For the purpose of merely obtaining a registered hall call pulse signal HCM-P, the number of data input terminals of the data selector $DS_{101}$ may be selected to be equal to the number of hall call buttons to receive the hall call button actuation signals respectively, and the binary-coded scan signals SF-A to SF-D may be applied to the select input terminals so as to easily derive the signal HCM-P. An arrangement as shown in FIG. 11 is, however, employed in the present invention in order to reduce the capacity of the data selector $DS_{101}$ and minimize the number of the gates 103 to 111.

Suppose now that the down hall call button 1D is depressed at the 1st floor as shown by the dotted line in FIG. 7. When the binary-coded scan signal SF-DN applied to the gate 120 has a high level, an inverted output of low level appears from the gate 120 and is applied to the left-hand side terminal of the down hall call button 1D, with the result that an output of high level appears from the gate 104. In the SF slot No. 20, the binary-coded scan signals SF-A to SF-D represent "4", and the data selector $DS_{101}$ selects the signal applied to the data input terminal D4. As a result, a hall call pulse signal HC-P' of high level appears at the output terminal Q of the data selector $DS_{101}$. This hall call pulse signal HC-P' is applied through gates 121 and 122 to a data input terminal D of a random access memory $RAM_{101}$. When the control pulse signal SE-F of high level is applied to a writing-in or memory-in-able terminal WE of the memory $RAM_{101}$, the data is written in the address No. 20 corresponding to the SF slot No. 20, and at the same time, an output of high level or a registered hall call pulse signal HCM-P of high level appears at the output terminal Q of the memory $RAM_{101}$.

Suppose then that up hall calls registered by the up hall call buttons 3U and 5U as shown in FIG. 7 are registered already in the memory $RAM_{101}$. In this case, in response to the application of the binary-coded scan signals SF-A to SF-D and SF-DN in the SF slots Nos. 7 and 9, the up hall calls registered by the depression of the buttons 3U and 5U are read out from the memory addresses Nos. 7 and 9 respectively. As a result, a registered hall call pulse signal HCM-P appears at the output terminal Q of the memory $RAM_{101}$ so that it can be used as the detected hall call pulse signal HC-P having a pulse waveform as shown in FIG. 8.

In the case in which hall calls allotted to the individual elevator cars are desired to be fixed without being re-allotted to another, a random access memory for storing such fixedly allotted hall calls may be connected to each drive control unit 5 as shown in FIG. 13 illustrating a second embodiment of the present invention. In such a case, the memory $RAM_{101}$ shown in FIG. 11 is unnecessary. In this case, the hall call detector 1 in FIG. 11 does not store the information registered hall calls, and as soon as a hall call is detected, this hall call is allotted to one of the elevator cars and stored in the drive control unit 5 associated with the selected elevator car.

It is to be noted in this connection that the elevator car to which a hall call is fixedly allotted will become unable to service this hall call when the elevator car is, for example, full loaded before servicing the hall call. (In such a situation, the service overload signal SL-OVF of high level appears.) When such a situation arises, the hall call allotted to the specific elevator car must necessarily be re-allotted to another.

Figure 12:
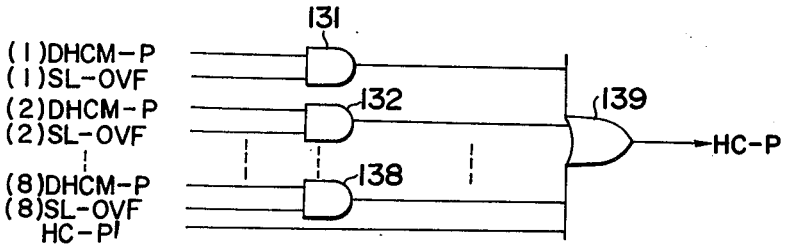

FIG. 12 shows a hall call re-allotment instruction circuit provided to deal with the above situation. Referring to FIG. 12, detected registered hall call pulse signals (1)DHCM-P to (8)DHCM-P and service overload signals (1)SL-OVF to (8)SL-OVF are applied to gates 131 to 138 associated with the individual elevator cars respectively. In FIG. 12, some of these gates and associated circuit portions are omitted and merely shown by the dotted lines. An output of high level appears from the gate 131 when the detected registered hall call pulse signal (1)DHCM-P of high level and the service overload signal (1)SL-OVF of high level are both applied to the gate 131. As a result, an output of high level or a detected hall call pulse signal HC-P of high level appears from a gate 139 to be used for the re-allotment of the hall call allotted already to the elevator car No. 1 to another.

In FIG. 11, diodes $D_{101}$ to $D_{108}$ are shown connected in series with the hall call buttons 1D to 6U respectively so as to avoid faulty registering operation that may take place when three or more of the hall call buttons are depressed simultaneously. Such faulty registering operation occurs when, for example, the hall call buttons 1U, 1D and 2D are depressed simultaneously. In such a case, an output of low level appears from the gate 120 due to the depression of the hall call buttons 1U and 1D although an output of high level should appear therefrom, and an up hall call originated from the 2nd floor would be registered in response to the depression of the down hall call button 2D.

Figure 3B:
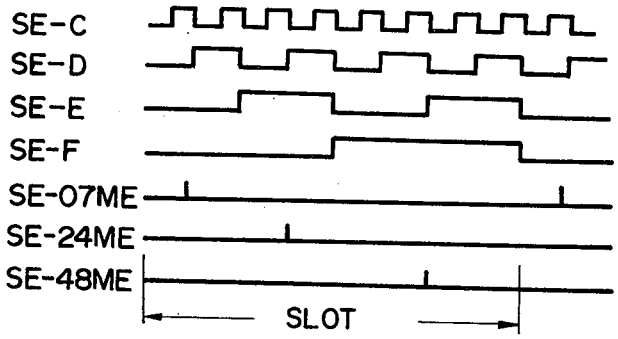

When a hall call, for example, an up hall call is originated from the 3rd floor by depressing the up hall call button 3U and is registered in the memory $RAM_{101}$, the data output appears at the output terminal Q during the first half of the SF slot No. 7 that is, during the period in which the binary-coded control pulse signal SE-F shown in FIGS. 2 and 3B has a low level. This data output is fed back to the data input terminal D of the memory $RAM_{101}$ through the gates 121 and 122 and is re-written in the memory $RAM_{101}$ during the $\frac{1}{2}$ to $\frac{3}{4}$ period in the latter half of the SF slot No. 7 in which the binary-coded control pulse signals SE-F and SE-E have a high level and a low level respectively. Suppose then that one of the elevator cars is located at the 3rd floor for upward movement, a hall call reset pulse signal HCR-P described later with reference to FIG. 20 has a high level to inhibit the gate 122. Therefore, the input to the memory $RAM_{101}$ is of low level, and the up hall call originated from the 3rd floor is reset. Another gate 123 illustrated by the dotted line in FIG. 11 is not necessarily required in the first embodiment of the present invention and is used for purposes described later. When such a gate 123 is not present, the memory-in-able terminal WE of the memory $RAM_{101}$ may merely be connected to a positive power supply terminal.

While one practical form of the hall call detector 1 has been described above, the circuit arrangement shown in FIG. 11 is directly applicable to the car call registers 4. The circuit structure of the car call registers 4 will become simpler than that shown in FIG. 11, since there is no need for taking the elevator car running direction into account in the case of car calls. For example, the gates 103 to 111 may be eliminated, and car call signals may be applied directly to the data input terminals D3 to D11 of the data selector $DS_{101}$. In this case, a registered car call signal CCM-P in pulse signal form appears at the output terminal Q of the memory $RAM_{101}$ depending on the levels of the binary-coded scan signals SF-A to SF-D representing the lower four bits.

The first preferred embodiment of the elevator control system according to the present invention has been described in full detail with reference to FIG. 1 showing the general structure thereof and with reference to FIGS. 2 to 12 showing the practical structure and operation of the individual blocks in FIG. 1.

It will be understood from the foregoing detailed description of the first preferred embodiment of the present invention that the elevator control system can be very simply constructed at low costs and can be very easily standardized for the following reasons:

(1) Hall calls and elevator service positions are synchronously detected by the binary-coded scan signals. Therefore, the detected hall calls and elevator car service positions can be utilized to remarkably simply attain the hall call allotting control.

(2) All the units including the hall call detector, elevator car service position signal generators and hall call allotting control unit are arranged for operation in synchronous relation with the binary-coded scan signals. Therefore, synchronization among various signals and units is utterly unnecessary, and any means for this purpose are also utterly unnecessary.

(3) The hall call signal, elevator car service position signal, etc. are converted into a pulse signal form by the binary-coded scan signals to be transmitted in serial fashion. Therefore, the number of signal transmission lines can be greatly decreased, and the efficiency of manufacture can be remarkably improved.

(4) An uneconomical cost-up and possible failure or trouble due to employment of an expensive electronic computer can be eliminated, since the elevator control system is designed for the purpose of exclusive control of the elevator cars.

(5) The elevator control system is easily applicable to a building of any size without being limited by the number of floors and the number of elevator cars and without requiring any substantial alterations in its structure. Thus, the elevator control system can be remarkably easily standardized in design.

(6) The elevator car service position signal and hall call signal, which are essentially required in whatever manner of elevator control, are converted into a pulse signal form in synchronous relation with the binary-coded scan signals. Therefore, the elevator control system can be used for other control purposes in spite of the fact that it consists of units of very simple structure.

Another preferred embodiment of the elevator control system according to the present invention will be described with reference to FIGS. 13 to 17. In the first form of the elevator control system described hereinbefore, various faults or troubles that may possibly occur in its components are not taken into consideration. In the second embodiment which will be described hereinunder, the possibility of various faults or troubles is taken into consideration in constructing the elevator control system.

FIG. 13 is a block diagram showing the general structure of the second embodiment of the present invention which is a modification of the first embodiment. The structure shown in FIG. 13 differs from that of the first embodiment in the following three major points:

(1) The elevator control system is divided into three major sections consisting of eight control blocks (1) to (8) provided for the individual elevator cars, a hall call detecting block (H), and a hall call allotting control block (S), which are electrically isolated from one another by means which permits transmission of various signals among them.

(2) The hall call detecting block (H) is subdivided into a pair of blocks (1H) and (2H) arranged for parallel operation.

(3) The signal generating unit 7 is disposed in each of these blocks.

Except for the above differences, the hall call detector 1, hall call allotting control unit 2, elevator car drive control units 5, service position signal generators 3, car call detectors 4, signal generating unit 7 employed in the first embodiment are also incorporated in the same form in this second embodiment. The hall call detector 1 is disposed in each of the subdivided hall call detecting blocks (1H) and (2H), and the hall call allotting control unit 2 is disposed in the hall call allotting control block (S). The drive control unit (1)5, service position signal generator (1)3 and car call detector (1)4 are disposed in the control block (1) provided for the elevator car No. 1 and so on, and the signal generating unit 7 is disposed in each of the blocks. Thus, the manner of elevator car operation control is the same as that described in the first embodiment, and so, the distinctive features of the second embodiments will be mainly described.

In FIG. 13, the control block (1) provided for the elevator car No. 1 is merely illustrated except the blocks common to all the elevator cars, but it is apparent that such control blocks are also provided for the remaining elevator cars.

The reason why the second embodiment is modified as specified in the above three points (1) to (3) and the effects exhibited by the modification will be initially described before describing the structure and operation thereof in detail.

In the first place, detected hall call pulse signals (1H)HC-P and (2H)HC-P are applied from the hall call detecting blocks (1H) and (2H) to the hall call allotting control block (S), and in addition, to each of the control blocks (1) to (8) provided for the individual elevator cars, so that a fatal trouble or fault that may occur in the hall call allotting control block (S) can be automatically detected in the elevator car control blocks (1) to (8). When such trouble is detected, hall call allotting pulse signals DHC-P are rendered ineffective, while detected hall call pulse signals HC-P are left effective so as to improve the reliability of the system.

Figure 14:
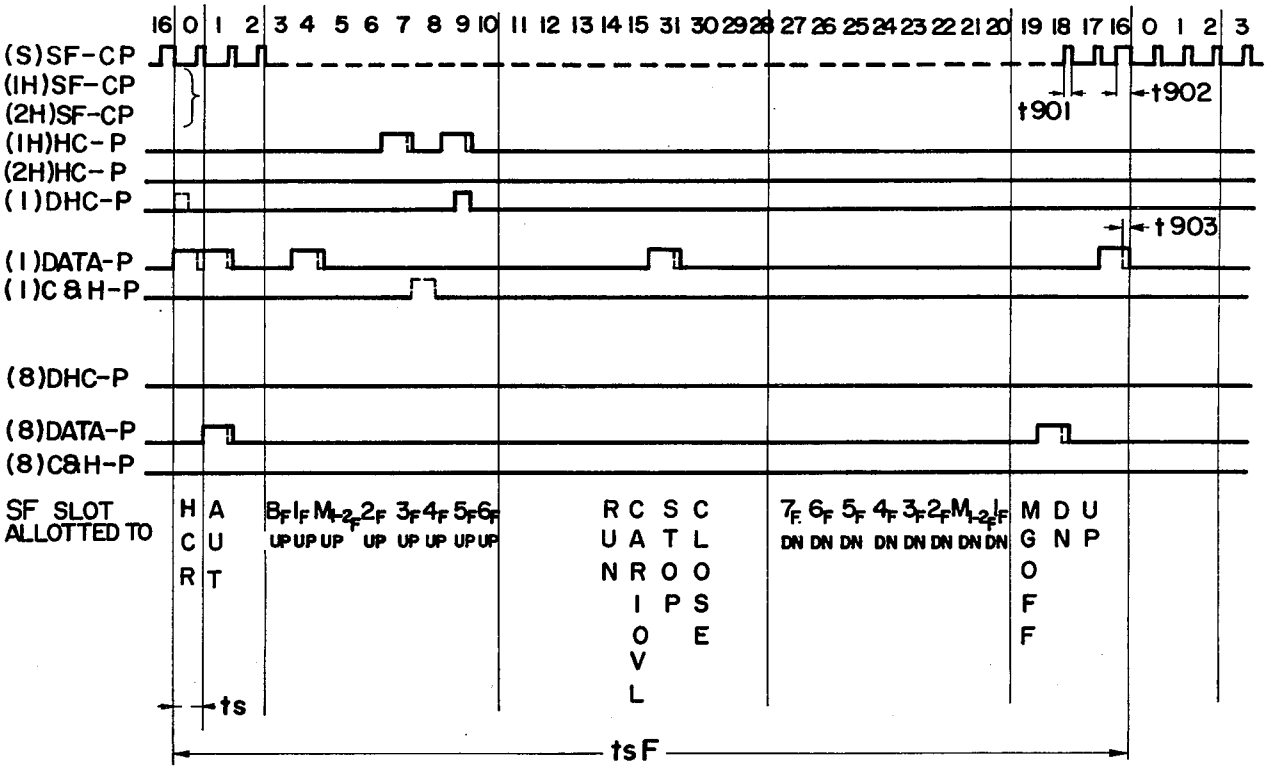

FIG. 14 is a timing chart illustrating the operating timing of the blocks shown in FIG. 13. Referring to FIG. 14, a pulse as shown by the dotted line appears in the unused SF slot No. 0 to be included in the hall call allotting pulse signal (1)DHC-P. The hall call allotting control unit (S) is constructed to provide such a pulse. A signal converter (1)891 disposed in the control block (1) provided for the elevator car No. 1 has such a function that it can detect continuation of the hall call allotting pulse signal (1)DHC-P of low level over one SF scan cycle $t_{SF}$. Thus, a first trouble (such as voltage drop due to blow-out of a fuse disposed in a DC power supply line or mal-contact in a signal transmission line) which may occur in the hall call allotting control block (S) can be detected by the elevator car control block (1). Upon detection of this first trouble, the detected hall call pulse signals (1H)HC-P and (2H)HC-P having been inhibited are rendered effective so as to run the individual elevator cars independently of one another.

The signal converter (1)891 functions also to detect continuation of the hall call allotting pulse signal (1)DHC-P of high level over a period of time $t_S$ corresponding to one SF scan slot, thereby detecting occurrence of a second trouble (such as destroyal of an integrated circuit) in the hall call allotting control block (S). Upon detection of this second trouble, the hall call allotting pulse signal (1)DHC-P is rendered ineffective, and the detected hall call pulse signals (1H)HC-P and (2H)HC-P having been inhibited are rendered effective so as to run the individual elevator cars independently of one another.

By virtue of the incorporation of such signal converter 891 in each of the elevator car control blocks (1) to (8), it is possible to reliably obviate such an undesirable situation that all the elevator cars are unable to service hall calls due to the first trouble occurred in the hall call allotting control block (S), and it is also possible to reliably automatically obviate such an undesirable situation that the elevator cars run cyclically and endlessly through the entire floor range due to the second trouble in spite of origination of no hall calls. In the case of the latter trouble, the elevator cars may be run independently of one another or some of them may be disconnected from the power supply.

In the second place, the reliability of the system can be improved by employing the two hall call detecting blocks arranged for parallel operation. In FIG. 13, the hall call detecting blocks (1H) and (2H) are adapted to detect hall calls originated from the odd-numbered floors and even-numbered floors respectively. However, the present invention is in no way limited to such a specific arrangement. For instance, these hall call detecting blocks (1H) and (2H) may be arranged to be separately connected to a pair of hall call registers disposed at the same floor so that one of them can continue to provide elevator service even when the other is disabled.

In the third place, the number of blocks adversely affected in function by the signal generating unit 7 when disabled can be limited so that the remaining blocks can continue to control the elevator cars. Further, the system can operate with improved performance against noises so as to greatly alleviate the requirements for signal transmission lines extending among the blocks and to avoid the necessity for fine regulations of the standards of these signal transmission lines. For example, there may be a case in which all the elevator car control elements cannot be disposed on the same floor depending on the shape of a building, and in such a case, the length of signal transmission lines extending between the blocks may become as long as several ten meters. The second embodiment comprises means for sufficiently dealing with such an extreme case.

To this end, the individual blocks are arranged for synchronous operation under control of the scan signals of relatively low frequency but not arranged for synchronous operation under control of the control pulse signals of relatively high frequency. The binary-coded scan signals SF-A to SF-D are not transmitted in parallel relation, and a synchronizing pulse signal (S)SF-CP as shown in FIG. 14 is used for attaining synchronous operation of the signal generating units 7 disposed in the individual blocks. Another signal converter 892 is incorporated in each of the elevator car control blocks (1) to (8) to detect continuation of the synchronizing pulse signal (S)SF-CP of high or low level over a predetermined period of time. When the synchronizing pulse signal (S)SF-CP of high or low level continues to appear over the predetermined period of time, it is changed over to another synchronizing pulse signal (1)SF-CP. When this synchronizing pulse signal (1)SF-CP and similar signals (2)SF-CP, (3)SF-CP, . . . are detected unsuitable for the control, an internally prepared control pulse signal is used to provide the binary-coded scan signals. Therefore, even if all of the blocks (S), (1H) and (2H) were disabled, the elevator cars can be run according to the instructions provided by the car call buttons.

The structure and operation of the second embodiment of the present invention will now be described in detail with reference to FIGS. 13 to 17.

Figure 15:
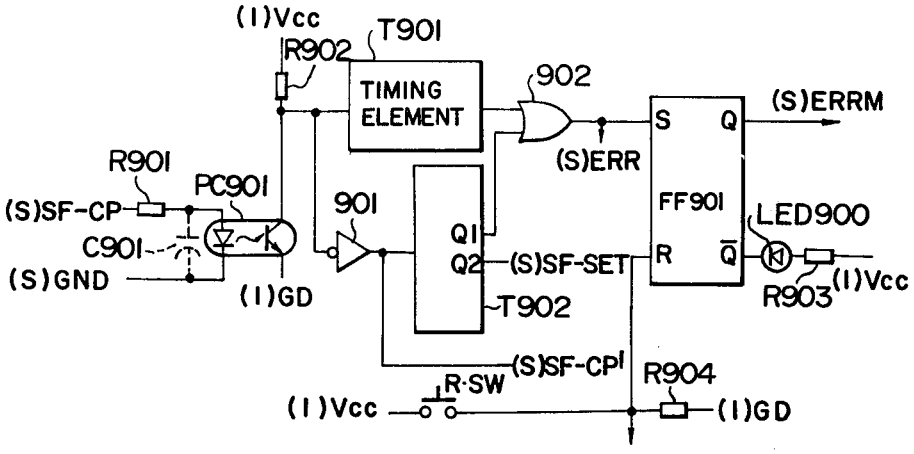
Figure 17:
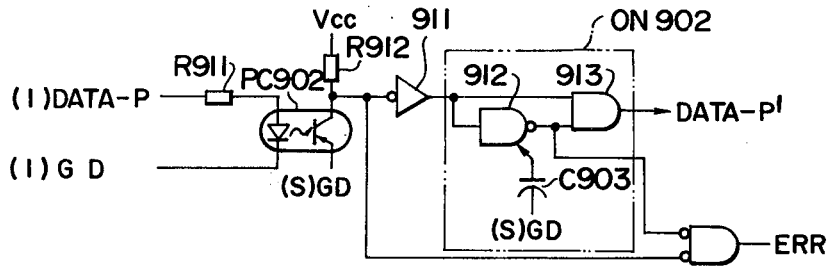

Referring to FIG. 13, hall call signals generated by hall call registers BH to 7H disposed at the 1st basement to the 7th floor above ground are applied by cables L804 and L803 to hall call detectors (1H)1 and (2H)1 to be converted into detected hall call pulse signals (1H)HC-P and (2H)HC-P respectively by the scan signals. These pulse signals (1H)HC-P and (2H)HC-P are applied to a gate 801 through signal converters 850 and 851 of structure as shown in FIG. 15 or 17, and the output of this gate 801 is applied through another gate 802 to a random access memory (S)$RAM_2$ to be stored therein. The gate 802 is reset by a hall call reset pulse signal HCR-P produced by gates 811 to 818 (812 to 817 not shown) to inhibit application of a detected hall call pulse signal HC-P thereto and to inhibit feedback of the memory output or registered hall call pulse signal HCM-P to the memory (S)$RAM_2$.

The hall call detectors (1H)1 and (2H)1 are similar in structure to the hall call detector HC shown in FIG. 1, although they are slightly modified. The registered hall call pulse signal HCM-P appearing from the memory (S)$RAM_2$ is applied to the hall call allotting control unit 2 to provide hall call allotting pulse signals (1)DHC-P to (8)DHC-P which are transmitted to the control blocks (1) to (8) provided for the elevator cars Nos. 1 to 8.

The hall call allotting pulse signal (1)DHC-P is applied to a signal converter (1)891 in the control block (1) provided for the elevator car No. 1, and the output of the signal converter (1)891 is applied through gates (1)822 and (1)820 to a random access memory (1)$RAM_1$ to be stored therein. A detected registered hall call pulse signal (1)DHCM-P appears from the memory (1)$RAM_2$ to be applied to the drive control unit (1)5. Target floor information, that is, car call information BC (corresponding to the 1st basement) to 7C (corresponding to the 7th floor above ground) registered on an operation board (1)OPB in the elevator car No. 1 is applied by way of a cable L810 to the car call register (1)4, and a registered car call pulse signal (1)CCM-P appears from the car call register (1)4 to be applied to the elevator car drive control unit (1)5. In response to the application of these call pulse signals and other signals including a service position pulse signal (1)SCAR-P as explained with reference to FIG. 9, the drive control unit (1)5 produces various control signals as explained with reference to FIG. 10 so that the elevator car No. 1 can service the calls allotted thereto or registered therein.

In the second embodiment shown in FIG. 13, calls are fixedly allotted to the elevator cars. However, when the hall call allotting control unit 2 described with reference to FIG. 4 is to be employed, a random access memory should be disposed in each of the hall call detecting blocks (1H) and (2H) as described in the first embodiment. In such a case, the memory (S)$RAM_2$ in the hall allotting control block (S), memories (1)$RAM_2$ to (8)$RAM_2$ in the individual elevator car control blocks (1) to (8) are unnecessary, and associated gates are also unnecessary.

In the second embodiment shown in FIG. 13, signal converters having a structure as shown in FIG. 15 or 17 are used for the signal transmission so that the individual blocks can be electrically isolated from one another to eliminate common-mode noises. In this connection, however, it is not expedient to directly couple the individual signals including the elevator car state signals required for the hall call allotting control. This is because many signal converters are required, and the number of lines interconnecting the individual blocks is inevitably increased.

In the second embodiment, therefore, an unused SF slot is utilized to convert the elevator car state signal into a pulse signal form by means of a signal serializer (1)839, and the pulse signal thus obtained is transmitted as a data pulse signal (1)DATA-P which may include the elevator car service position pulse signal (1)SCAR-P so as to apply the same through a signal converter (1)853 to a signal reproducer (1)831 in the hall call allotting control block (S) for reproducing the original continuous waveform of the signal therefrom.

One practical form of, for example, a signal converter (1)892 will be described in detail with reference to FIG. 15.

Figure 16:
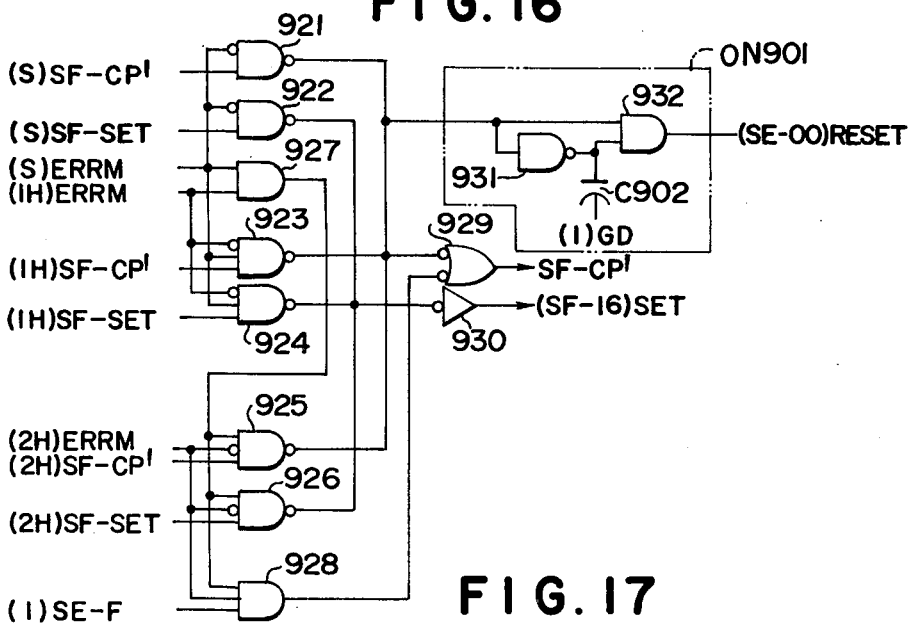

In response to the application of the scan synchronizing pulse signal (S)SF-CP, the circuit shown in FIG. 15 acts to convert the input into signals which are applied to a signal selecting unit shown in FIG. 16. Referring to FIG. 15, the output side of the signal converter (1)892 is completely electrically isolated from the input side by a photo-coupler $PC_{901}$. The input (S)SF-CP to the signal converter (1)892 consists of continuously periodically recurring pulses of the same pulse width except that corresponding to the SF slot No. 16 as seen in FIG. 14.

When, however, the hall call allotting control unit (S) is disabled for some reasons as described previously, a situation may occur in which no pulse input (S)SF-CP is applied to the signal converter or a high level thereof persists over the period of SF slots Nos. 1 and 2. Such situations are detected by timing elements $T_{901}$ and $T_{902}$ respectively, and an error output (S)ERR of high level appears from a gate 902 to be applied to the set input terminal S of a flip-flop $FF_{901}$ to be stored therein. An error signal (S)ERRM appears from the output terminal Q of the flip-flop $FF_{901}$, and at the same time, another output is applied from the other output terminal $\overline{Q}$ of the flip-flop $FF_{901}$ to a light-emitting diode $LED_{900}$ to visually display that the pulse signal input (S)SR-CP is faulty. A push button switch RSW is provided to reset the flip-flop $FF_{901}$. After the cause of the trouble is removed, this push button switch RSW is depressed to reset the error signal (S)ERRM. When so desired, the flip-flop $FF_{901}$ may be removed, and the error output signal (S)ERR of the gate 902 may be directly used to indicate the trouble.

The scan synchronizing pulse signal (S)SF-CP, as well as the other scan synchronizing signals, has a larger pulse width $t_{902}$ in the SF slot No. 16 than that $t_{901}$ as shown in FIG. 14 so as to reliably achieve initial synchronization after the turn-on of power supply. The pulse having the larger pulse width $t_{902}$ is detected by the timing element $T_{902}$, and a signal (S)SF-SET appears from the timing element $T_{902}$ to be used for setting the binary-coded scan signals to represent the bits of the SF slot No. 16.

This set signal (S)SF-SET is applied through gates 922 and 930 in the signal selecting unit shown in FIG. 16 to the counter $CU_2$ in the signal generating unit 7 shown in FIG. 2, so that the counter $CU_2$ can produce the binary-coded scan signals SF-A to SF-D and SF-DN representing the bits of the SF slot No. 16.

In FIG. 16, it is supposed that gates 925 and 927 are inhibited by the error signal (S)ERRM of low level. When, however, the timing element $T_{901}$ or $T_{902}$ detects that the scan synchronizing pulse signal (S)SF-CP is faulty, the error signal (S)ERRM of high level appears from the flip-flop $FF_{901}$ to inhibit gates 921 and 922 and to release gates 924 and 925 from the inhibited state, so that a set signal (1H)SF-SET is applied from the first hall call detecting block (1H) to be used in lieu of the set signal (S)SF-SET.

Synchronization of the scan signals and synchronization of the control pulse signals will next be described. Since the scan synchronizing pulse signal (S)SF-CP has the waveform shown in FIG. 14, the falling edge of the pulse appearing at the rear end of each individual slot is preferably utilized to count up the count of the counter $CU_2$ in the scan signal generator in the signal generating unit (1)7 disposed in the elevator car control unit (1) thereby advancing the slot number. In FIG. 15, the presence of elements such as the photo-coupler $PC_{901}$ and noise absorbing capacitor $C_{901}$ will result in a delay time of signal transmission. Although such delayed signal transmission may be remedied by advancing the falling edge of the scan synchronizing pulses to attain complete synchronization, this method is not so successful since the delay time tends to fluctuate. In the present invention, a method as described below is employed to solve the problem of delayed signal transmission although a slight delay may occur in the synchronized signals. The method comprises transmitting, for example, the hall call allotting pulse signal (1)DHC-P with the timing of the control pulse signal SE-24ME, and using this signal (1)DHC-P with the timing of the control pulse signal SE-56ME in the control block (1H) provided for the elevator car No. 1, as described with reference to FIGS. 6 and 10.

It is also necessary to provide synchronization of the control pulse signals. To this end, a converted scan synchronizing pulse signal (S)SF-CP' is applied from the circuit shown in FIG. 15 to the count input terminal CK of the counter $CU_2$ shown in FIG. 2 through gates 921 and 929 shown in FIG. 16, and the counter $CU_2$ counts up by counting the pulses at the falling edge thereof. The output of the gate 921 is also applied to a single pulse generator $ON_{901}$. In response to the application of the output of the gate 921, the pulse generator $ON_{901}$ generates a single pulse (SE-OO)RESET having a pulse width shorter than that of the pulse output CK of the pulse generator PG in FIG. 2 when the input voltage level changes from a low level to a high level, that is, when the pulse of the scan synchronizing pulse signal (S)SF-CP falls down, thereby resetting the counter $CU_1$ in FIG. 2.

When all the inputs, that is, the scan synchronizing pulse signals (S)SF-CP, (1H)SF-CP and (2H)SF-CP applied to the signal converter (1)892 in FIG. 13 are faulty, and all the error signals (S)ERRM, (1H)ERRM and (2H)ERRM of high level are applied to the signal selecting unit shown in FIG. 16, gates 921 to 926 are inhibited, and the signals (SE-OO)RESET and (SF-16)SET are unable to appear. The gate 928 is released from its inhibited state, and the counter $CU_2$ operates under control of a control pulse signal (1)SE-F produced internally by the signal generating unit (1)7.

The individual blocks shown in FIG. 13 can thus operate independently of one another. This arrangement is quite convenient in that, even when some of the blocks are not yet completed and are still unable to operate as in the stage of installation, adjustment or repair of the elevator control system, the remaining blocks can operate independently of such blocks or other elevator blocks to make trial run of the elevator car or cars and to achieve various kinds of adjustment as required by originating car calls. Further, even after the elevator control system is completed, the elevator car or cars can be run under instructions provided by car calls or special instructions so long as the elements of at least the associated block or blocks can operate trouble-free. Therefore, even in a worst case, the possibility is utterly obviated in which the persons in the elevator car are confined therein without the hope of escapement due to a faulty operation of the system.

All the signal converters shown in FIG. 13 may have a structure similar to that shown in FIG. 15. In the case of, for example, the signal converter (1)853 which receives the data pulse signal (1)DATA-P which may include the signal representing the service position of the elevator car No. 1, it may have a simplified structure as shown in FIG. 17.

In the timing chart shown in FIG. 14, the data pulse signal (1)DATA-P is illustrated under assumption that the elevator car No. 1 is an automatic elevator car which is located at the 1st floor for upward movement with its door open. (This signal (1)DATA-P will not be described in detail as it has not direct concern with the understanding of the present invention.)

The data pulse signal (1)DATA-P differs from the scan synchronizing pulse signal SF-CP in that it indicates merely data allotted to predetermined ones of the individual SF slots, and a signal selecting unit as shown in FIG. 16 is unnecessary for this signal (1)DATA-P. It is thus necessary to detect an erroneously appearing low or high level of this signal (1)DATA-P. Therefore, the signal (1)DATA-P is detected faulty merely when a high level persists over a predetermined length of time, and when detected faulty, this signal (1)DATA-P is reset.

The above point is taken into acount in constructing the simplified signal converter shown in FIG. 17. Referring to FIG. 17, the simplified form of the signal converter comprises a timing means of simple structure consisting of a gate 912 with an inverting terminal and a capacitor $C_{903}$. The timing is preferably shorter than the period $t_{SF}$ of one scan cycle. Desirably, the pulses of the data pulse signal (1)DATA-P are cut by a period of time $t_{903}$ (which may be equal to $t_{901}$) at the rear end of the associated SF slots so that the pulse width thereof may not exceed the period of time $t_S$ of each SF slot.

While the second embodiment of the present invention has been described in detail hereinbefore, it is apparent that the second embodiment is in no way limited to the specifically illustrated form. For example, the hall call detecting blocks (1H) and (2H) shown in FIG. 13 are arranged to detect hall calls originated from the odd-numbered and even-numbered floors respectively. Such an arrangement is employed to ensure full utilization of the features of the elevator control system, because, even in the event of failure of the block (1H), the hall call buttons of the hall call registers at the 2nd, 4th and 6th floors are still effective, and the passengers waiting at the 1st, 3rd, 5th and 7th floors can depress these hall call buttons by going up or down the stairs.

However, when a pair of hall call registers are provided at the same floor, one of the blocks (1H) and (2H) can be selected when the other is disabled, so that all the hall calls originated from the entire floor range can be serviced even in such a case. That is, even when one of the hall call transmitting blocks is disabled, signals can be transmitted by the other block to ensure trouble-free operation of all the elevator cars. Further, a pair of car call registers classified by a plurality of operation boards or odd-numbered and even-numbered floors may be provided in each individual elevator car, so as to prevent all the elevator cars from being rendered totally inoperative due to trouble occurring in one of the car call register pairs. The above arrangement makes unnecessary at the same time, the operation boards OPB in the elevator cars and cables L810 leading to the elevator car control blocks (1) to (8). Therefore, three signal lines used for the transmission of the scan synchronizing pulse signal SF-CP, registered car call pulse signal CCM-P and reset pulse signal CCR-P and two power supply lines are merely required for each individual elevator car irrespective of the number of floors, and the number of expensive tail cords, which has been about ten, can be reduced to only one.

In the second embodiment of the present invention, one scan signal generator is incorporated in each of the elevator car control blocks. It is therefore possible to ensure continuous operation of all the elevator cars under control of the elevator car control means in the normal blocks even when one of the blocks is disabled. It is also possible to detect trouble in each individual block and to make necessary repairs for each individual block. It is also apparent that the second embodiment exhibits all the effects exhibited by the first embodiment.

A modification of the hall call allotting control unit 2 shown in FIG. 6 will be described with reference to FIG. 18.

Figure 18:
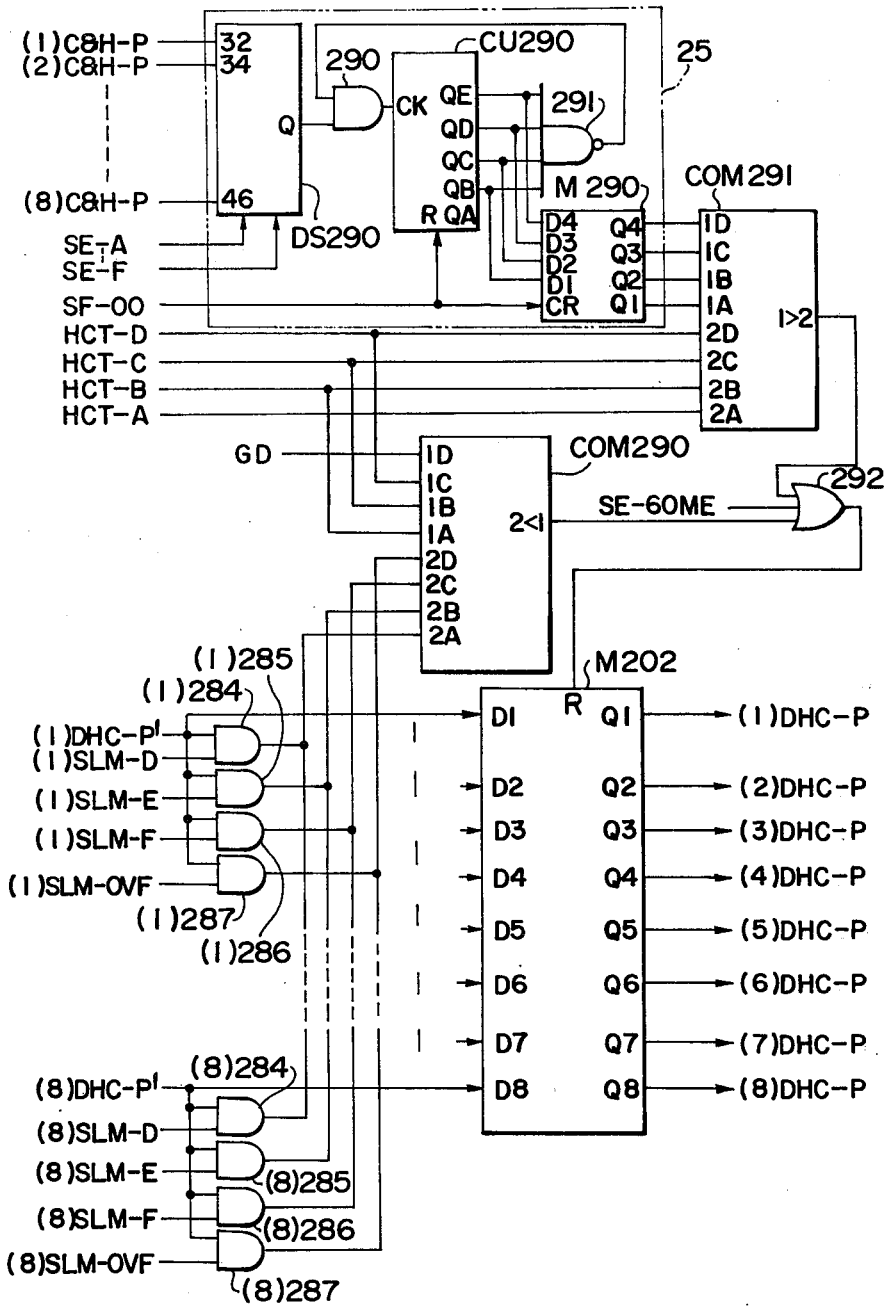

FIG. 18 shows a partial modification of the memory $M_{202}$ shown in FIG. 6. The operation of the hall call allotting control unit 2 shown in FIG. 6 is such that, in response to the application of the hall call allotting instruction pulse signals (1)DHC-P' to (8)DHC-P', the information is stored in the memory $M_{202}$ under control of the control pulse signal SE-60ME, and the hall call allotting pulse signals (1)DHC-P to (8)DHC-P appear from the memory $M_{202}$.

In the case of the hall call allotting control unit 2 shown in FIG. 18, however, the information is not stored in the memory $M_{202}$ as soon as the hall call allotting instruction pulse signals (1)DHC-P' to (8)DHC-P' are applied, and the information is stored in the memory $M_{202}$ taking into account the overall traffic demand and the factors including the service loads of the allotted elevator cars. It is thus possible to make uniform the waiting time at the hall call originating floors and to prevent re-allotment of the hall calls due to full loading.

In FIG. 18, the memory $M_{202}$ corresponds to the memory $M_{202}$ shown in FIG. 6, and the block 25 represents a unit which computes the total service load. Referring to FIG. 18, pulse signals C & H-P (referred to hereinafter as stop-demanding call signals) representing the logical sum of registered car call pulse signals and allotted hall call pulse signals are applied from the individual elevator car control units (1) to (8) to a data selector $DS_{290}$. The binary-coded control pulse signals SE-A to SE-F are applied to the data selector $DS_{290}$ so as to extract all the stop-demanding calls for the elevator cars Nos. 1 to 8 in time division fashion during the period of even-numbered SF slots Nos. 32 to 46. The pulse signal output of the data selector $DS_{290}$ is applied through a gate 290 to the count terminal CK of a counter $CU_{290}$ which counts the number of pulses included in the input. Gates 291 and 290 act to prevent over-counting of the counter $CU_{290}$.

Upon completion of one scan cycle, the count of the counter $CU_{290}$ is registered in a memory $M_{290}$ under control of the control pulse signal SE-OO. Therefore, the numerial value registered in the memory $M_{290}$ is proportional to the number of all the stop-demanding calls, that is, the total service load. The memory $M_{290}$ applies an output representing this total service load to a comparator $COM_{291}$. Binary coded elapsed time signals HCT-A to HCT-D are applied to the comparator $COM_{291}$ from a computing unit (not shown) which computes the length of time elapsed after registration of a hall call to be allotted. (Although not shown, such a computing unit can be simply provided by a timer or like means which counts the length of time elapsed after registration of a hall call.) The comparator $COM_{291}$ compares the elapsed time provided by these signals HCT-A to HCT-D with the total service load. A pulse appears from the comparator $COM_{291}$ to reset the memory $M_{202}$ when the total service load is more than the time elapsed after registration of the hall call to be allotted. In this manner, allotment of the specific hall call is inhibited.

The binary-coded elapsed time signals HCT-A to HCT-D are also applied to another comparator $COM_{290}$. Applied also to this comparator $COM_{290}$ are service load signals SLM-D, SLM-E, SLM-F and SLM-OVF appeared in the preceding scan cycle and associated with a selected elevator car. (These service load signals SLM-D, SLM-E, SLM-F and SLM-OVF are the outputs of the memory $M_{201}$ shown in FIG. 5.) As shown in FIG. 18, the service load signals associated with the elevator cars, for which the hall call allotting instruction signals (1)DHC-P' to (8)DHC-P' have appeared, are only applied to the corresponding input terminals of the comparator $COM_{290}$. The comparator $COM_{290}$ generates similarly a pulse to reset the memory $M_{202}$ when the service loads of the elevator cars Nos. 1 to 8 are more than the length of time elapsed after the registration of the hall call to be allotted. The hall call, which is inhibited from allotment, is thus temporarily held from allotment before the allotting control is carried out again in the succeeding scan cycle. The control pulse signal SE-60ME is also applied to the gate 292 so as to reset the hall call allotting pulse signals (1)DHC-P to (8)DHC-P at the end of each SF slot.

It will be seen from the above description that the modification shown in FIG. 18 is effective in that a hall call can be allotted taking into account the total service load and the service loads of the elevator cars having hall calls allotted already. The circuit shown in FIG. 18 is remarkably simple in structure due to the fact that all the signals used for the above purpose are completely synchronized.

A second modification of the hall call allotting control unit 2 will be described with reference to FIG. 19.

The principal feature of this second modification resides in the fact that a hall call is preferentially allotted taking car calls into account. Suppose, for example, that an up hall call is originated from the 4th floor in the diagram shown in FIG. 7. Then, this up hall call is preferably preferentially allotted to the elevator car No. 4 having the car call for the 4th floor registered already prior to the allotment of the new hall call by an elevator car selecting unit 20, so that the number of stops required for all the elevator cars can be reduced by one, and the average waiting time can be correspondingly shortened. Such manner of hall call allotment is usually practiced in the art of elevator control.

Figure 19:
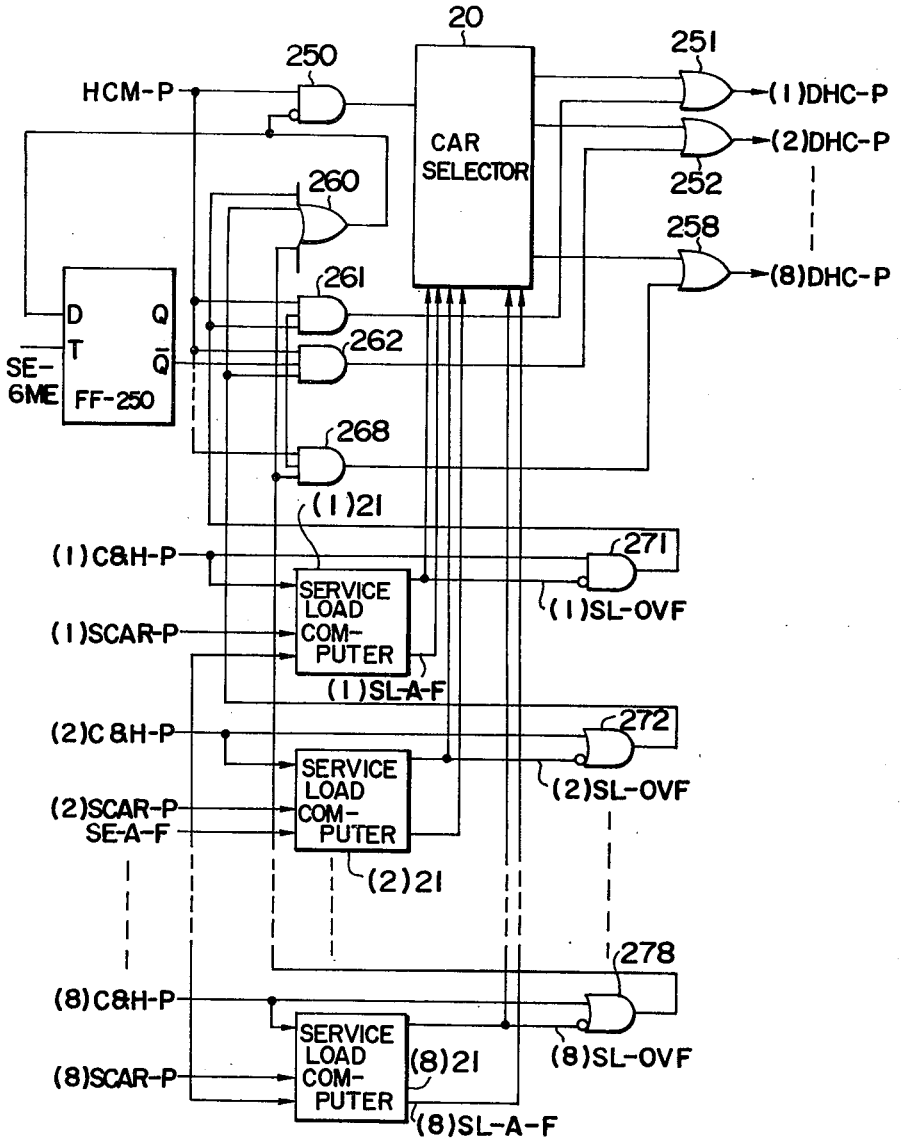

The practical structure of the elevator car selecting unit 20 shown in FIG. 19 is the same as that described with reference to FIG. 6.

The operation of the hall call allotting control unit 2 shown in FIG. 19 will now be described with reference to the case in which such a new up hall call is originated from the 4th floor, by way of example. A registered hall call pulse signal HCM-P of high level appears in the SF slot No. 8 and is applied through a gate 250 to the elevator car selecting unit 20, so that this new up hall call can be allotted to one of the elevator cars. However, a stop-demanding call pulse signal (2)C & H-P of high level appears due to the registration of the car call for the 4th floor in the elevator car No. 2 prior to the allotment of this new up hall call to one of the elevator cars. An output of high level appears from a gate 272 when the service load of the elevator car No. 2 is relatively small and the signal SLM-OVF is of low level. In response to the application of the registered hall call pulse signal HCM-P of high level and the output of high level from the gate 272, an output of high level appears from a gate 262 to be applied to another gate 252. As a result, a hall call allotting pulse signal (2)DHC-P of high level appears from the gate 252 to preferentially allot this new up hall call to the elevator car No. 2. The output of the gate 272 is also applied to a gate 260 to inhibit the gate 250. Therefore, the elevator car selecting unit 20 is inhibited from operation.

The thus allotted hall call information is registered in the memory (2)$RAM_2$ which is provided for the elevator car No. 2 and has the same structure as that of the memory (1)$RAM_2$ provided for the elevator car No. 1 and shown in FIG. 13. In the SF slot No. 8, the stop-demanding call pulse signal C & H-P associated with the elevator car No. 2 has a high level due to the allotment of the new up hall call originated from the 4th floor and inhibits the gate 250 before the control pulse signal SE-06ME is applied to a flip-flop $FF_{250}$. In response to the application of the control pulse signal SE-06ME, the flip-flop $FF_{250}$ is set, and an output of low level appears from the output terminal $\overline{Q}$ to inhibit all of gates 261 to 268. Therefore, once the new up hall call originated from the 4th floor is allotted to the elevator car No. 2, such up hall call is not allotted to another elevator car even when a car call for the 4th floor is registered therein.

A modification of the generator generating the hall call reset pulse signal HCR-P will be described with reference to FIGS. 20 and 21.

The hall call detecting block (1H) or (2H) shown in FIG. 13 may be provided with a hall call registering function as shown in FIG. 11. The modification shown in FIG. 20 is intended to cooperate with such hall call detecting block (1H) or (2H), so that hall call reset signals (1)HCR to (8)HCR associated with the respective elevator cars and applied to the gates 811 to 818 for producing the hall call reset pulse signals (1)HCR-P to (8)HCR-P in FIG. 13 can be rendered unnecessary. That is, this modification is intended to eliminate the circuits which transmit the hall call reset pulse signals (1)HCR-P to (8)HCR-P from the associated elevator car control blocks (1) to (8) to the hall call detecting blocks (1H) and (2H).

Figure 20:
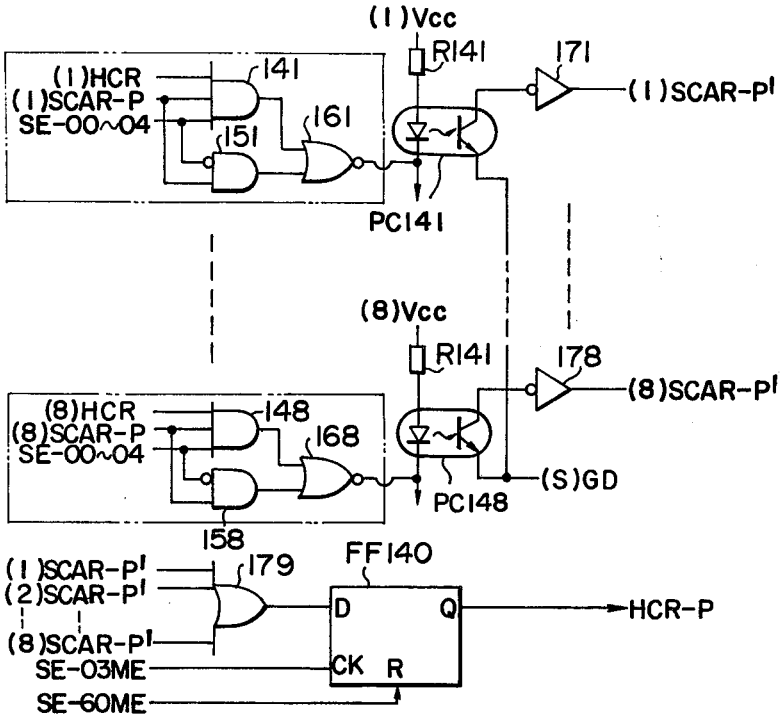

The modification shown in FIG. 20 is featured by the fact that the service position pulse signal (1)SCAR-P is not directly transmitted through the gate (1)819 as shown in FIG. 13, but is modified by the elevator car service state signal. That is, the service position pulse signal (1)SCAR-P is directly transmitted when the elevator car No. 1 can respond to a hall call and the hall call reset signal (1)HCR of high level appears to indicate that this elevator car No. 1 can service this hall call. However, when the hall call reset signal (1)HCR has a low level, a gate 141 is inhibited, and the service position pulse signal (1)SCAR-P is inhibited from passing through the gate 141 during the initial SF slot period in which the control pulse signals SE-00 to SE-04 have the high level. Thus, a modified service position pulse signal (1)SCAR-P′ appears from a gate 171.

Figure 21:
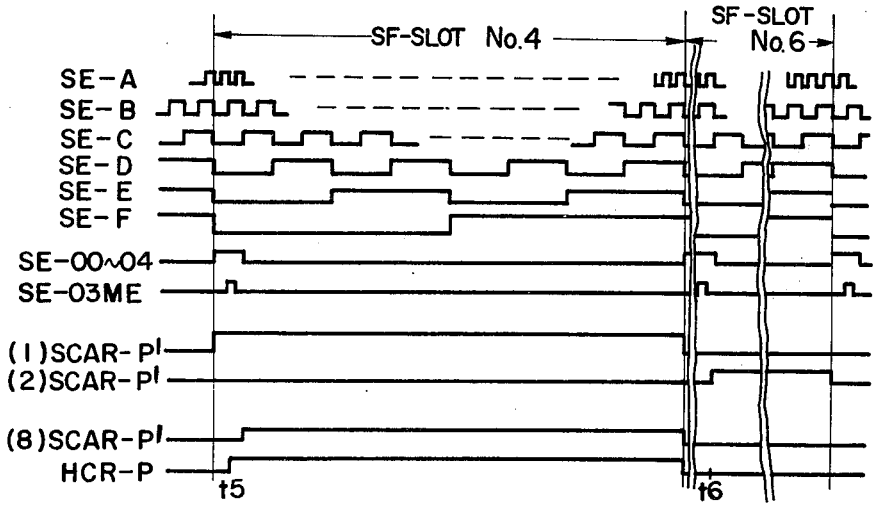

FIG. 21 is a timing chart illustrating the operation of the circuit shown in FIG. 20, and it is supposed that the individual cars are located in a state as shown in FIG. 7.

The elevator car No. 1 is located at the 1st floor for upward movement, and the hall call reset signal (1)HCR of high level appears. Thus, the modified service position pulse signal (1)SCAR-P′ has a high level throughout the SF slot No. 4. In contrast, the elevator car No. 8 is placed in the shutdown state, and the hall call reset signal (8)HCR of low level acts to inhibit a gate 148. Therefore, a modified service position pulse signal (8)SCAR-P′ of high level appears after time $t_5$.

The modified service position pulse signals (1)SCAR-P′ to (8)SCAR-P′ are applied to an OR gate 179, and the control pulse signal SE-03ME appearing before time $t_5$ is utilized to register the output of the gate 179 in a flip-flop $FF_{140}$. The output of this flip-flop $FF_{140}$ provides the hall call reset pulse signal HCR-P.

In the SF slot No. 4, the hall call reset pulse signal HCR-P has a high level to reset an up hall call originated from the 1st floor, since the elevator car No. 1 is located at the 1st floor for upward movement. In the case of the elevator car No. 2, it is running between the 1st and 2nd floors. Thus, in the SF slot No. 6, the hall call reset signal (2)HCR has a low level, and the modified service position pulse signal (2)SCAR-P turns to a high level at time at which the control pulse signal SE-03ME takes its high level. Therefore, the hall call reset pulse signal HCR-P remains in the low level, and an up hall call which may be originated from the 2nd floor by depressing the up hall call button 2U can be registered.

The basic concept of the present invention and various embodiments of the elevator control system based on the above concept have been described in detail in the above. Those skilled in the art will readily understand from the foregoing description that the elevator control system according to the present invention is quite inexpensive and simple in construction. The present invention is especially effective in improving the operating efficiency of the advanced elevator system in which a plurality of elevator cars arranged for parallel operation run under the hall call allotting control in the manner described in the embodiments. The elevator control system of the present invention is easily applicable to buildings of various heights without substantially requiring time-consuming alterations of the circuit design. Such advantages can be obtained due to the fact that, in the elevator control system according to the present invention, a scan signal generator is provided to sequentially scan all the service floors of a building in one direction and the other, and the scan signal is utilized to convert hall calls and elevator car service positions into synchronized pulse signals and to detect such hall calls and service positions by these synchronized pulse signals. Due to the fact that hall calls and elevator car service positions are detected to be converted into the synchronized pulse signals, computation of elevator car service time, resetting of the results of computation, allotment of hall calls, resetting of registered hall calls, etc. can be easily achieved as described in detail in the embodiments. It is apparent that the present invention is in no way limited to the specific embodiments and is also similarly effectively applicable to various other elevator control systems.

What we claim is:

1. An elevator control system for controlling a plurality of elevator cars servicing a plurality of service floors, comprising:

means for determining a service position of each car depending on the physical position of the car and its travelling direction, means for sequentially scanning all of the floors at a predetermined scan timing in upward and downward directions, alternately, means for successively computing the service loads of each car at the timings in scanning of said floors by successively registering values representing the time intervals required for said each car to travel to the respective floors following the service position of said each car, hall call allotting control means responsive to the occurrence of a hall call to allot said hall call to one of the cars on the basis of the service loads of the cars obtained at the scan timing of the floor where said hall call is produced, said hall call allotting control means comprises means for comparing the service loads of the respective cars with each other to select one of the cars which has the smallest service load and means for allotting said hall call to said selected car, drive control means for controlling the drive condition of the cars according to the allotment by said hall call allotting control means, and means for detecting a hall call produced in synchronism with the scanning of the floors, and means for detecting a service position of each car in synchronism with the scanning of the floors, and wherein said service load computing means comprises means for successively registering values representing time intervals required for each car to travel from the service position of said each car to the respective floors scanned following detection of said service position, and said hall call allotting control means comprises means responsive to said hall call detected to compare the values of the service loads of the respective cars registered at the scan timing when said hall call is detected.

2. An elevator control system according to claim 1, wherein said hall call allotting means further comprises means for selecting one of the cars which has the smallest service load upon comparison of the service loads of the respective cars and means for allotting said hall call to said selected car.

3. An elevator control system according to claim 1, wherein said service load computing means comprises means for clearing the registered time interval representing value upon occurrence of said service position.

4. An elevator control system according to claim 1, wherein said service load computing means further comprises means for additively registering at each scan timing of each floor a value corresponding to a time interval required for said each car to stop in response to a call at a floor existing between said service position and a position of each scanned floor.

5. An elevator control system according to claim 4, wherein said hall call allotting control means comprises means for comparing the service loads of the respective cars with each other to select one of the cars which has the smallest service load and means for allotting said hall call to said selected car.

6. An elevator control system according to claim 4, further comprising control pulse producing means for producing a plurality of control pulses for each floor and wherein said service load computing means comprises means for additively counting said control pulses to a number corresponding to a time interval required for travelling to a floor and additionally, if said each car is to be stopped at the floor in response, a number of said control pulses required to stop there.

7. An elevator control system according to claim 4, wherein said service load computing means comprises means for clearing the registered time interval representing value upon the occurrence of said service position.

8. An elevator control system according to claim 1, wherein said service load computing means further comprises means for predetermining a plurality of values depending on car operating conditions including car stoppage, a car running and power supply shutdown, and means for additively registering, in said service position, a selected one of said values corresponding to said each car's operating condition.

9. An elevator control system according to claim 8, wherein said service load computing means further comprises means for additively registering in each scan timing for each floor a value corresponding to a time interval required for said each car to stop in response to a call at a floor existing between said service position and a position of each scanned floor.

10. An elevator control system according to claim 1, further comprising hall call resetting means responsive to the service position of any one of the cars for resetting a hall call derived from a floor where said service position pulse signal is produced.

11. An elevator control system according to claim 1, further comprising allotted hall call memory means for memorizing a hall call which has been allotted to one of the cars by said hall call allotting control means, means for producing an allotted hall call pulse signal at the scan timing corresponding to said allotted hall call, and means responsive to said allotted hall call pulse signal for inhibiting further detection of said hall call.

12. An elevator control system according to claim 1, wherein said system is divided into a plurality of blocks and said scan signal generating means are provided in each of said blocks, respectively.

13. An elevator control system according to claim 12, wherein said scan signal generating means provided in the respective blocks are operated in synchronism with each other.

14. An elevator control system according to claim 12, wherein said scan signal generating means provided in the respective blocks are isolated from each other except for connection through signal transmission means with each other.

15. An elevator control system according to claim 12, further comprising at least one block having means for detecting a hall call.

16. An elevator control system according to claim 12, further comprising a plurality of blocks each having means for detecting a hall call.

17. An elevator control system according to claim 12, further comprising separate blocks provided in the respective cars, each having means for detecting a car call.

18. An elevator control system according to claim 12, wherein said service position determining means is provided, as a separate block, in each of the cars.

19. An elevator control system according to claim 12, wherein said hall call allotting control means is provided, as a separate block, in each of the cars.

20. An elevator control system according to claim 12, wherein a part of said system specific to a specific car is arranged in a separate block and a part of said system common to all the cars is arranged in a different separate block.

21. An elevator control system according to claim 20, wherein said blocks include a first block which is provided with a first part of said system common to all the cars and including means for detecting a hall call, a second block which is provided with a second part of said system common to all the cars and including said hall call allotting control means and a third block provided for each car and including means for detecting a car call and said car service position determining means specific to said each car.

22. An elevator control system according to claim 21, further comprising means for enabling the system to control the elevator cars by using said first and third blocks, while said second block is rendered inoperative.

23. An elevator control system for controlling a plurality of elevator cars servicing a plurality of service floors, comprising:

means for producing a service position of each car which is variable depending on the physical position of the car and its travelling direction, means for scanning all of the floors, successively, in upward and downward directions, alternately, means for detecting a hall call derived from any one of the floors in synchronism with the scanning of the floors, means for detecting the service position of each car in synchronism with the scanning of the floors, means for registering service load values of each car for the respective floors, successively, at timings of the scanning of said respective floors following the detection of said service position of said each car; said service load values representing time intervals required for said each car to travel from said service position to said respective floors, hall call allotting control means responsive to the hall call detected by said hall call detecting means to allot said detected hall call to one of the cars on the basis of the service loads of the respective cars which are registered at the scan timing when said hall call is detected, and drive control means for controlling the drive condition of the cars according to the allotment by said hall call allotting control means.

* * * * *